US012698577B2

(12) United States Patent
Boriskina et al.

(10) Patent No.: US 12,698,577 B2
(45) Date of Patent: Aug. 4, 2026

(54) HIGH-PERFORMANCE MONO-MATERIAL HYBRID YARNS AND TEXTILES

(71) Applicant: MASSACHUSETTS INSTITUTE OF TECHNOLOGY, Cambridge, MA (US)

(72) Inventors: Svetlana V. Boriskina, Winchester, MA (US); Volodymyr Korolovych, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 18/996,643

(22) PCT Filed: Jun. 26, 2023

(86) PCT No.: PCT/US2023/069066
§ 371 (c)(1),
(2) Date: Jan. 17, 2025

(87) PCT Pub. No.: WO2024/086387
PCT Pub. Date: Apr. 25, 2024

(65) Prior Publication Data

US 2025/0257500 A1 Aug. 14, 2025

Related U.S. Application Data

(60) Provisional application No. 63/400,706, filed on Aug. 24, 2022.

(51) Int. Cl.
*D02G 3/32* (2006.01)
*D01F 6/04* (2006.01)
(Continued)

(52) U.S. Cl.
CPC ..... *D02G 3/32* (2013.01); *D01F 6/04* (2013.01); *D02G 3/02* (2013.01); *D02G 3/36* (2013.01);
(Continued)

(58) Field of Classification Search
None
See application file for complete search history.

(56) References Cited

U.S. PATENT DOCUMENTS 3,023,192 A 2/1962 Shivers, Jr.
4,330,989 A * 5/1982 Schmieder ..... D01D 4/02 57/227
(Continued)

FOREIGN PATENT DOCUMENTS

WO 2024086387 A2 4/2024

OTHER PUBLICATIONS

Delva, Laurens, et al. "Mechanical recycling of polymers for dummies." Capture-Plastics to Resource (2019).
(Continued)

*Primary Examiner* — Shawn Mckinnon
(74) *Attorney, Agent, or Firm* — Barnes & Thornburg LLP

(57) ABSTRACT

Novel yarns for use in manufacturing fully sustainable textiles are provided. The yarns can be composite yarns made of two or more monofilament or multi-filament yarns, including an elastic core and a sheath disposed around the elastic core. Each of the core and the sheath are made of hydrocarbons (e.g., polyethylene and various derivatives thereof) and/or other fully-recyclable materials. The performance of the resulting yarns is on par with, if not better than, existing yarns, fabrics, and fibers with respect to tenacity, elasticity, and auxetic performance. As a result, textiles can be made from the yarns, and then the textiles themselves can
(Continued)

be fully recyclable such that the textile can be recycled and then a new textile can be formed from the same materials of the old textile. Methods of formulating the yarns and textiles are also provided.

19 Claims, 10 Drawing Sheets

(51) Int. Cl.
*D02G 3/02* (2006.01)
*D02G 3/36* (2006.01)

(52) U.S. Cl.
CPC .. *D10B 2321/021* (2013.01); *D10B 2401/061* (2013.01); *D10B 2401/063* (2013.01)

(56) References Cited

U.S. PATENT DOCUMENTS 8,002,879 B2 * 8/2011 Hook ..... D02G 3/32 428/36.1
2002/0065384 A1 * 5/2002 Knight ..... C08L 23/04 428/374

OTHER PUBLICATIONS

Fonseca, C.A.; Harrison, I.R. An investigation of co-crystallization in LDPE/HDPE blends using DSC and TREF. Thermochimica Acta 1998, 313, 37-41.
Grigore, M.E. Methods of recycling, properties and applications of recycled thermoplastic polymers. Recycling 2017, 2, 24.
Nomura, Keiichiro, et al. "Multiblock copolymers for recycling polyethylene-Poly (ethylene terephthalate) mixed waste." ACS applied materials & interfaces 12.8 (2020): 9726-9735.
Nyoni, A.B.; Brook, D. Wicking mechanisms in yarns—the key to fabric wicking performance. Journal of the Textile Institute 2006, 97, 119-128.
https://www.epa.gov/facts-and-figures-about-materials-waste-and-recycling/textiles-material-specific-data.
Vollmer, Ina, et al. "Beyond mechanical recycling: giving new life to plastic waste." Angewandte Chemie International Edition 59.36 (2020): 15402-15423.
Barone, Justin R. "Polyethylene/keratin fiber composites with varying polyethylene crystallinity." Composites Part A: Applied Science and Manufacturing 36.11 (2005): 1518-1524.
Lai, S.M.; Li, C.H.; Kao, H.C.; Liu, L.C. Shape Memory Properties of Melt-Blended Olefin Block Copolymer (OBC)/Ethylene-Vinyl Acetate Blends. Journal of Macromolecular Science, Part B 2019, 58, 174-191.
Xu, Yanfei, et al. "Nanostructured polymer films with metal-like thermal conductivity." Nature communications 10.1 (2019): 1771.
Burger, C., Hsiao, B.S.; Chu, B. Preferred orientation in polymer fiber scattering. Journal of Macromolecular Science, Part C: Polymer Reviews 2010, 50, 91-111.
Veitmann, Marie, et al. "Understanding and control of high temperature oxidation flaws of low-density poly (ethylene) with Raman spectroscopy." International Journal of Spectroscopy 2014.1 (2014): 194563.
Wojdyr, Marcin. "Fityk: a general-purpose peak fitting program." Applied Crystallography 43.5 (2010): 1126-1128.
Engel, Martin, et al. "Small-angle X-ray scattering (SAXS) off parallel, cylindrical, well-defined nanopores: from random pore distribution to highly ordered samples." Applied Physics A 97 (2009): 99-108.
Korolovych, Volodymyr F., et al. "Thermally responsive hyperbranched poly (ionic liquid) s: assembly and phase transformations." Macromolecules 51.13 (2018): 4923-4937.
Korolovych, V.F.; Cherpak, V.; Nepal, D.; Ng, A.; Shaikh, N.R.; Grant, A.; Xiong, R.; Bunning, T.J.; Tsukruk, V.V. Cellulose nanocrystals with different morphologies and chiral properties. Polymer 2018, 145, 334-347.
Zheng, Jiajia, and Sangwon Suh. "Strategies to reduce the global carbon footprint of plastics." Nature climate change 9.5 (2019): 374-378.
Falinski, Mark M., et al. "A framework for sustainable nanomaterial selection and design based on performance, hazard, and economic considerations." Nature nanotechnology 13.8 (2018): 708-714.
Niinimäki, Kirsi, et al. "The environmental price of fast fashion." Nature Reviews Earth & Environment 1.4 (2020): 189-200.
Acar, M., Dudeney, W. L., Jones, J., Jackson, M. R. & Malalasekera, W. Laser Fusion to Impart Cohesion to Textured Filament Yarns. J. Ind. Text. 34, 181-193 (2005).
Alberghini, M., Hong, S., Lozano, L. M., Korolovych, V., Huang, Y., Signorato, F., Zandavi, S. H., Fucetola, C., Uluturk, I., Tolstorukov, M. Y., Chen, G., Asinari, P., Osgood, R. M., Fasano, M. & Boriskina, S. V. Sustainable polyethylene fabrics with engineered moisture transport for passive cooling. Nat. Sustain. 4, 715-724 (2021).
Allwood, J. M., Laursen, S. E., Rodríguez, C. M. de & Bocken, N. M. P. Well dressed? The present and future sustainability of clothing and textiles in the United Kingdom. (2006). doi:ISBN 1-902546-52-0.
M. Alshukur and A. Fotheringham, "Structural Ratio of Multi-thread Fancy Yarn: Interaction Effect of Both the Number of Wraps and the Overfeed Ratio on Fancy Bouclé Yarn Structure," J. Nat. Fibers, pp. 1-10, Nov. 2019, doi: 10.1080/15440478.2019.1692320.
M. Alshukur, A. Fotheringham, and H. Gong, "The influence of component stiffness on the structure of multi-thread fancy boucle yarn," J. Ind. Text., vol. 49, No. 7, pp. 889-905, Sep. 2018, doi: 10.1177/1528083718801365.
An, L., Shao, Z., Armstrong, J. N., Huang, Y., Hu, Y., Li, Z., Faghihi, D. & Ren, S. Hierarchical Structural Engineering of Ultrahigh-Molecular-Weight Polyethylene. ACS Appl. Mater. Interfaces 12, 50024-50032 (2020).
Ashby, M. F. in (ed. Ashby, M. F. B. T.-M. and S. D.) 211-239 Chapter 14—The Vision: A Circular Materials Economy in Materials and Sustainable Development (Butterworth-Heinemann, 2016). doi:https://doi.org/10.1016/B978-0-08-100176-9.00014-1.
Binsbergen, F. L. "Orientation-induced nucleation in polymer crystallization." Nature 211.5048 (1966): 516-517.
Hicks, M., H. E., J., U. A. & John, D. Spandex Elastic Fibers. Science (80-. ). 147, 373-379 (1965).
Bisinella, V., Albizzati, P. F., Astrup, T. F. & Damgaard, A. Life Cycle Assessment of grocery carrier bags. (2018).
Boriskina, S. V. An ode to polyethylene. MRS Energy Sustain. 6, E14 (2019).
Bhat, G., Chand, S. & Yakopson, S. Thermal properties of elastic fibers. Thermochim. Acta 367-368, 161-164 (2001).
Casey, P., Chen, H., Poon, B., Bensason, S., Menning, B., Liu, L., Hu, Y., Hoenig, W., Gelfer, M., Dems, B. & Rego, M. Polyolefin Based Crosslinked Elastic Fiber: A Technical Review of DOW XLATM Elastic Fiber Technology. Polym. Rev. 48, 302-316 (2008).
Ellen Macarthur Foundation Circular Fashion—A New Textiles Economy: Redesigning fashion's future. (2017). at <https://www.ellenmacarthurfoundation.org/publications/a-new-textiles-economy-redesigning-fashions-future>.
Deitzel, J. M., McDaniel, P. & Gillespie, J. W. 7—High performance polyethylene fibers in Structure and Properties of High-Performance Fibers Woodhead Publ. Ser. Text. (ed. Bhat, G. B. T.-S. and P. of H.-P. F.) 167-185 (Woodhead Publishing, 2017). doi:https://doi.org/10.1016/B978-0-08-100550-7.00007-3.
Fukushima, Y., Murase, H. & Ohta, Y. Dyneema®: Super Fiber Produced by the Gel Spinning of a Flexible Polymer in High-Performance Spec. Fibers 109-132 (Springer Japan, 2016). doi:10.1007/978-4-431-55203-1_7.
García, R. A., Carrero, A., Martin, C. & Dominguez, C. Effects of the structural components on slow crack growth process in polyethylene blends. Composition intervals prediction for pipe applications. J. Appl. Polym. Sci. 121, 3269-3276 (2011).

(56) References Cited

OTHER PUBLICATIONS

Häubler, M., Eck, M., Rothauer, D. & Mecking, S. Closed-loop recycling of polyethylene-like materials. Nature 590, 423-427 (2021).
Hees, T., Zhong, F., Stürzel, M. & Mülhaupt, R. Tailoring Hydrocarbon Polymers and All-Hydrocarbon Composites for Circular Economy. Macromol. Rapid Commun. 40, 201800608 (2018).
Hees, T., Schirmeister, C. G., Pfohl, P., Hofmann, D. & Muelhaupt, R. Self-Reinforcement via 1D Nanostructure Formation during Melt Blending of Thermoplastics and Thermoplastic Elastomers with Nanophase-Separated UHMWPE/HDPE Wax Reactor Blends. ACS Appl. Polym. Mater. 3, 3455-3464 (2021).
Hsu, P.-C., Song, A. Y., Catrysse, P. B., Liu, C., Peng, Y., Xie, J., Fan, S. & Cui, Y. Radiative human body cooling by nanoporous polyethylene textile. Science (80-. ). 353, 1019-1023 (2016).
Hu, J., Lu, J. & Zhu, Y. New Developments in Elastic Fibers. Polym. Rev. 48, 275-301 (2008).
International Preliminary Report on Patentability for Application No. PCT/US2023/069066 date of mailing Apr. 15, 2024 (12 pages).
Khariwala, D. U., Taha, A., Chum, S. P., Hiltner, A. & Baer, E. Crystallization kinetics of some new olefinic block copolymers. Polymer (Guildf). 49, 1365-1375 (2008).
Liu, Mingjin, et al. "The retarded recovery of disentangled state by blending HDPE with ultra-high molecular weight polyethylene." Polymer 192 (2020): 122329.
Lv, F., Yao, D., Wang, Y., Wang, C., Zhu, P. & Hong, Y. Recycling of waste nylon 6/spandex blended fabrics by melt processing. Compos. Part B Eng. 77, 232-237 (2015).
Muthu, S. S., Li, Y., Hu, J. Y. & Mok, P. Y. Recyclability Potential Index (RPI): The concept and quantification of RPI for textile fibres. Ecol. Indic. 18, 58-62 (2012).
M. Naeimirad, A. Zadhoush, R. Kotek, R. Esmaeely Neisiany, S. Nouri Khorasani, and S. Ramakrishna, "Recent advances in core/shell bicomponent fibers and nanofibers: A review," J. Appl. Polym. Sci., vol. 135, No. 21, p. 46265, Jun. 2018, doi: https://doi.org/10.1002/app.46265.
O'Connor, T. C. & Robbins, M. O. Chain Ends and the Ultimate Strength of Polyethylene Fibers. ACS Macro Lett. 5, 263-267 (2016).
Park, J. H. & Rutledge, G. C. 50th Anniversary Perspective: Advanced Polymer Fibers: High Performance and Ultrafine. Macromolecules 50, 5627-5642 (2017).
Park, J. H. & Rutledge, G. C. Ultrafine high performance polyethylene fibers. J. Mater. Sci. 53, 3049-3063 (2018).
Peng, Y., Chen, J., Song, A. Y., Catrysse, P. B., Hsu, P.-C., Cai, L., Liu, B., Zhu, Y., Zhou, G., Wu, D. S., Lee, H. R., Fan, S. & Cui, Y. Nanoporous polyethylene microfibres for large-scale radiative cooling fabric. Nat. Sustain. 1, 105-112 (2018).
F. A. Reifler, R. Hufenus, M. Krehel, E. Zgraggen, R. M. Rossi, and L. J. Scherer, "Polymer optical fibers for textile applications—Bicomponent melt spinning from cyclic olefin polymer and structural characteristics revealed by wide angle X-ray diffraction," Polymer (Guildf)., vol. 55, No. 22, pp. 5695-5707, 2014, doi: https://doi.org/10.1016/j.polymer.2014.08.071.
Roiron, C., Lainé, E., Grandidier, J.-C., Garois, N. & Vix-Guterl, C. A Review of the Mechanical and Physical Properties of Polyethylene Fibers. Text. 1, (2021).
Rosenboom, J.-G., Langer, R. & Traverso, G. Bioplastics for a circular economy. Nat. Rev. Mater. (2022). doi:10.1038/s41578-021-00407.
Schirmeister, C. G., Hees, T., Licht, E. H. & Mülhaupt, R. 3D printing of high density polyethylene by fused filament fabrication. Addit. Manuf. 28, 152-159 (2019).
Shirvanimoghaddam, K., Motamed, B., Ramakrishna, S. & Naebe, M. Death by waste: Fashion and textile circular economy case. Sci. Total Environ. 718, 137317 (2020).
Kimata, S., Shuichi, K., Takashi, S., Yoshinobu, N., Tatsuya, K., Noboru, Y., Takeshi, K., Mitsuhiro, S. & A., K. J. Molecular Basis of the Shish-Kebab Morphology in Polymer Crystallization. Science (80-. ). 316, 1014-1017 (2007).
Siddiqa, F., Haque, M., Smriti, S. A., Farzana, N., Abu, N. M. & Haque, A. Effect of Elastane and Thread Density on Mechanical Attributes of Stretch Woven Fabric. AATCC J. Res. 7, 21-30 (2020).
M. Strååt, M. Rigdahl, and B. Hagström, "Conducting bicomponent fibers obtained by melt spinning of PA6 and polyolefins containing high amounts of carbonaceous fillers," J. Appl. Polym. Sci., vol. 123, No. 2, pp. 936-943, Jan. 2012, doi: https://doi.org/10.1002/app.34539.
Tong, J. K., Huang, X., Boriskina, S. V., Loomis, J., Xu, Y. & Chen, G. Infrared-transparent visible-opaque fabrics for wearable personal thermal management. ACS Photonics 2, 769-778 (2015).
Utracki, L. A. Polyethylenes and Their Blends. In: Utracki, L., Wilkie, C. (eds) Polymer Blends Handbook (eds. Utracki, L. A. & Wilkie, C. A.) 1559-1732 (Springer Netherlands, 2014). doi:10.1007/978-94-007-6064-6_21.
Wang, Y., Gregory, C. & Minor, M. A. Improving Mechanical Properties of Molded Silicone Rubber for Soft Robotics Through Fabric Compositing. Soft Robot. 5, 272-290 (2018).
Wu, B., Cai, Y., Zhao, X. & Ye, L. Fabrication of well-miscible and highly enhanced polyethylene/ultrahigh molecular weight polyethylene blends by facile construction of interfacial intermolecular entanglement. Polym. Test. 93, 106973 (2021).
Yin, Y., Yao, D., Wang, C. & Wang, Y. Removal of spandex from nylon/spandex blended fabrics by selective polymer degradation. Text. Res. J. 84, 16-27 (2013).
Zhang, L., Lu, C., Dong, P., Wang, K. & Zhang, Q. Realizing mechanically reinforced all-polyethylene material by dispersing UHMWPE via high-speed shear extrusion. Polymer (Guildf). 180, 121711 (2019).
Zhao, Y., Zhu, Y., Sui, G., Chen, F., Zhang, Q. & Fu, Q. The effect of hard block content on the orientation and mechanical properties of olefin block copolymer films as obtained via melt stretching. RSC Adv. 5, 82535-82543 (2015).
Zhao, Y., Zhu, Y., Sui, G., Chen, F. & Fu, Q. Tailoring the crystalline morphology and mechanical property of olefin block copolymer via blending with a small amount of UHMWPE. Polymer (Guildf). 109, 137-145 (2017).
Tyvek (DuPont USA). at <http://www.dupont.com/products-and-services/fabrics-fibers-nonwovens/protective-fabrics/brands/tyvek.html>.

* cited by examiner

HIGH-PERFORMANCE MONO-MATERIAL HYBRID YARNS AND TEXTILES

CROSS REFERENCE TO RELATED APPLICATIONS

This application is a U.S. national counterpart application of International Patent Application No. PCT/US2023/069066, entitled "High-Performance Mono-Material Hybrid Yarns and Textiles," filed Jun. 26, 2023, claims priority to and the benefit of U.S. Provisional Application No. 63/400,706, entitled "High-Performance Mono-Material Hybrid Yarns and Textiles," filed on Aug. 24, 2022, the content of each of which is incorporated by reference herein in its entirety.

GOVERNMENT RIGHTS

This invention was made with government support under N68335-21-C-0489 awarded by The Naval Air Systems Command, and under W911NF-13-D-0001 awarded by the Army Research Office. The government has certain rights in the invention.

FIELD

The present disclosure relates to processes for fabricating mono-material fibers, composite yarns, and textiles made from these fibers and/or yarns, and more particularly relates to engineering composite yarns from same-material fibers (e.g., olefin fibers) in a manner that can allow them to perform on par with or even better than composite yarns fabricated from single-network elastomers (e.g., spandex) and other high-performance fibers (e.g., polyester and nylon).

BACKGROUND

The increasing demand for value and performance in wearable apparel, industrial textiles, and soft robotics has fueled innovation in the development of new polymer materials with either high strength or high elastic recovery properties. Two important characteristics of any yarn and textile are tenacity and elasticity. While synthetic fibers, such as polyester and nylon, offer high tenacity, commonly used elastic materials include silicone and polyurethane rubbers. Silicone rubber has an advantage of being resistant to environmental factors, such as temperature, oil, acid, and/or alkali, however, it has low tensile strength. Polyurethane rubber exhibits higher tenacity, however, it is accompanied by poor resistance to temperature, moisture, and acids, and also has sub-par elastic properties. The elastomer most commonly used in textiles is a synthetic polyether-polyurea copolymer, best known in the fiber form by names such as spandex, Lycra®, and/or elastane. Most of high-performance textiles combine different types of polymers and other organic materials, which are often impossible to separate at the end of the textile life-cycle. Well-known examples of multifunctional polymeric blends can be combinations of high tenacity fibers (forming a composite yarn sheath) and elastomeric fibers (forming the composite yarn core), such as, polyester-spandex, as shown in FIGS. 1*a*-1*b*, as discussed in greater detail below, or nylon-spandex yarns used in stretchy athletic apparel. An estimated 80% of clothing sold in the United States contained spandex fibers in 2010, and these fibers are typically produced via a solution dry spinning method. The process of spandex manufacturing is energy-intensive and involves the use of a variety of toxic chemicals.

The low tensile strength of spandex fibers also necessitates their use in heterogeneous blended yarns and textiles, in combination with higher-tenacity fibers like polyester or nylon. The high-strength synthetic fibers are typically thermoplastics that are fabricated via a melt spinning process and are mechanically recyclable—but only if the textile or a garment is homogenous (i.e., contains only one type of a thermoplastic polymer). However, the majority of pre- and post-consumer textile waste is heterogeneous in composition. Owing to the difficulties in separating these very different polymers via standard mechanical recycling techniques, most of the textiles are landfilled at the end of their lifecycle, contributing to the microplastic pollution and the loss of valuable materials that can be recycled individually. To reclaim nylon or polyester content from these hybrid fabrics while sacrificing the elastic polymer component, existing technologies can use either solvent extraction, which involves harsh chemicals and elevated temperature and pressure processes, or selective degradation of spandex via heat treatment or hydrolysis, followed by ethanol washing. More generally stated, the problem with current yarns, fibers, and textiles is that fashion and functionality often sacrifices sustainability, with many textiles unable to be fully sustainable at least because some components thereof are not sustainable. For example, many textiles cannot be easily recycled at least because one or more actions must be taken to make the textile recyclable, such as removing some portion (e.g., buttons, buckles, etc.) of the same.

Accordingly, to build sustainable circular textile ecosystem, the development of new types of yarns and textiles with low or negative environmental footprint in production, base polymer material abundance, non-toxicity, and/or low cost is desirable. It is further desirable that such yarns and textiles be durable, easy to maintain, and/or for the final textile product (e.g., a garment) to be recyclable (preferably, at least mechanically recyclable).

SUMMARY

The present application is directed to a novel bio-inspired approach to textile engineering and manufacturing that includes embedding new functionalities into homogeneous textiles via structural hierarchical engineering of fibers and yarns rather than by blending chemically dissimilar materials. For example, the present disclosure provides for a design and manufacturing pipeline to prototype polyethylene-based yarns and textiles. These yarns and textiles can be engineered for full circularity, and—similarly to natural hierarchical materials—can derive their different mechanical properties from the variations in the fiber structure, density, surface texture, and/or arrangement into complex yarns rather than from variations in the material chemistry. For example, the present disclosure provides for the engineering of polyethylene (PE) to achieve desired properties by tuning a chemical architecture and intermolecular interactions in the material. The resulting new fibers and yarns can exhibit strong resistance to environmental degradation, mechanical properties spanning the range from the values typical for single-network-elastomers (such as spandex) to high-performance fibers (such as nylon), auxetic performance, as well as mechanical recyclability and/or chemical recyclability.

One non-limiting, exemplary material for the new circular and functional yarns is PE, owing it its low cost, light weight, durability, non-toxicity, low cradle-to-grave environmental footprint, and tremendous opportunities for passive cooling via control of radiation, conduction, and/or evaporation processes. Other useful properties of PE materials include excellent chemical resistance, near-zero moisture absorption, low coefficient of friction, and/or ease of processing. PE is a family of simple linear olefin thermoplastic polymers composed of only carbon (C) and hydrogen (H) atoms, made by polymerizing ethylene monomers. Most commercially available PE fibers and textiles can be engineered for industrial applications, and can exhibit high strength and stiffness for unparalleled protection against cuts, abrasion, ballistic impact, chemical treats, and/or hazards. These include "stronger then still" yet very expensive Dyneema® fibers manufactured by DSM (Heerlen, Netherlands) by using a proprietary gel-spinning process, and water-repellent nonwoven Tyvek® materials exhibiting high abrasion, aging and chemical resistance produced by DuPont (Wilmington, DE). However, poor elastic properties and high hydrophobicity of these materials prevent their applications for wearable or bedding textiles.

The present disclosure supports that with proper engineering PE fibers and yarns can exhibit soft touch and capillary moisture wicking performance, making them particularly desirable for wearable textiles with passive cooling capabilities. As disclosed, the range of functionalities of the PE-based fibers are expanded to enable manufacture of mechanically recyclable elastic and/or auxetic core-sheath yarns via scalable fiber melt-spinning and yarn twisting techniques at low cost and with performance exceeding that of commercial elastic polyester-spandex yarns of similar structure. High tensile strength and elastic recovery together with extreme chemical resistance and non-toxicity of the disclosed PE-based yarns make them a promising material for athletic wear, undergarments, textiles for automotive and healthcare applications, and artificial muscles for soft robotics, among other uses provided for herein or readily derivable from the present disclosures by a person skilled in the art.

More particularly, the present disclosure provides for a process to fabricate mono-material complex yarns and textiles composed from olefin fibers (and/or other fibers as disclosed herein) that are engineered to exhibit one or more, if not all, of the following properties: (i) high tensile strength (e.g., approximately in a range of about 0.3 GPa to about 1.5 GPa); (ii) excellent elastic recovery (e.g., approximately in a range of about 90% stretch deformation to about 100% stretch deformation); (iii) auxetic behavior (e.g., with a negative Poisson ratio approximately in a range from about −0.1 to about-20); (iv) strong resistance to environmental degradation; and (v) full mechanical or chemical recyclability. The olefin (and/or other) fibers can be composed of hydrocarbon monomers only, but can feature different molecular weight and polymer chain structure, crystallinity, and/or polymer chain alignment. These fibers can be fabricated by scalable melt-spinning techniques from (linear) low density polyethylene monomers (LDPE or LLDPE), medium density polyethylene (MDPE), high density polyethylene (HDPE), ultra-high molecular weight polyethylene (UHMWPE), olefin block co-polymers (OBC), and/or a blend of any such materials, among others. The present disclosure demonstrates that these fibers can be engineered to exhibit mechanical properties spanning the range from the values typical for single-network elastomers (e.g., spandex) to high-performance fibers (e.g., polyester, nylon). Further, as provided for herein, the fabrication can feasibly be both low-cost and large-scale. The fabrication can result in mechanical recycling of olefin-based mono-material yarns with a mechanical performance exceeding that of commercial yarns of similar structure composed of a polyester-spandex blend, paving the road to engineering mono-material sustainable textiles. These mono-material textiles can find applications in passive cooling technologies and soft robotics, among other uses, and the resulting textiles can be 100% recyclable at the end of their lifecycle. Further, the recyclable monomaterial yarns of the present disclosure can allow the yarns to be used as part of a textile, and to be recycled such that the monomaterial yarns can be used in a different textile (the same or different type of textile). In contrast, existing materials do not typically allow for a yarn, fiber, and/or fabric to be used in a textile and in another textile because different blends make it difficult to go back-and-forth.

X-ray scattering techniques confirmed that by controlling PE crystallinity and alignment of crystalline domains as provided for herein, structural disorder in PE fibers can be widely tuned, which exhibit crystallinity values approximately in the range of about 8% to about 60%. This variation of molecular structure of a fiber also translates into a wide range of specific stiffness values (e.g., up to about 20 MPa/(kg/m$^3$)) and specific strength values (e.g., up to about 2 MPa/(kg/m$^3$)). Remarkably, new PE yarns resulting from the present disclosure outperform commercial hybrid complex yarns in terms of both tensile strength and elastic recovery (e.g., above about 90%). Accordingly, the yarns of the present disclosure, including those disclosed herein or otherwise derivable from the present disclosures, can find applications in, for example, passive cooling textile technologies, pressure-control medical textiles, and soft robotics. Usefully, the resulting yarns, and materials produced from the same (e.g. textiles) can be 100% mechanically and/or chemically recyclable at the end of their lifecycle.

One exemplary embodiment of a yarn includes an elastic core and a sheath. The elastic core is comprised only of one or more of: (a) materials made from hydrocarbons; or (b) other fully-recyclable materials. The sheath is comprised only of one or more of: (a) polyethylene; (b) other materials made only of hydrocarbons; or (c) other fully-recyclable materials. The yarn is fully-recyclable and made only of one or more: (a) hydrocarbon polymers; or (b) other fully-recyclable materials of the same elemental composition as the one or more materials of the elastic core.

Both the elastic core and the sheath can include thermoplastic. The thermoplastic can include an olefin block copolymer. In some embodiments, neither the polyethylene nor the olefin block polymer when it is present, is cross-linked.

The one or more of materials made from hydrocarbon of the elastic core can include one or more materials made only from hydrocarbons. Further, the hydrocarbon polymers can include all-hydrocarbon polymers. At least one of the elastic core or the sheath can include at least one of: (a) a low density polyethylene (LDPE); (b) a linear low density polyethylene (LLDPE); (c) a medium density polyethylene (MDPE); (d) a high density polyethylene (HDPE); (e) an ultra-high molecular weight polyethylene (UHMWPE); (f) an olefin block co-polymer (OBC); or (g) a blend of any of the same. Such a blend can be in any combination and/or any variation of amounts.

At least one of the elastic core or the sheath can include at least one of single component fiber, bi-component fiber, or tri-component fiber. The at least one of single component fiber, bi-component fiber, or tri-component fiber can include at least one of a core-sheath fiber type, a side-by-side fiber type, or an islands-in-the sea fiber type.

The yarn can include one or more of the following properties: (i) high tensile strength (e.g., approximately in the range of about 0.3 GPa to about 1.5 GPa); (ii) elastic recovery (e.g., approximately in the range of about 90% stretch deformation to about 100% stretch deformation); and/or (iii) auxetic behavior (e.g., with a negative Poisson ratio approximately in a range from about −0.1 to about −20). Another non-limiting property it can include is strong resistance to environmental degradation.

In some embodiments, the yarn can be fully-recyclable either mechanically or chemically while maintaining a tensile strength of the original yarn in a recycled yarn. The yarn can be formed via a melt-spin process.

Embodiments of a textile that includes the yarn described in any of the preceding paragraphs that are part of the present disclosure. A non-limiting example of such a textile can include a garment and one or more garment accessories. Non-limiting examples of the garment accessory(ies) can include a button or a buckle.

A method of making yarn includes melt-spin processing an elastic core, melt-spin processing a sheath, and disposing the sheath around the elastic core to form a fully-recyclable yarn made only of one or more of: (a) hydrocarbons; or (b) fully-recyclable materials. The elastic core is comprised only of one or more of: (a) materials made from hydrocarbons; or (b) other fully-recyclable materials, while the sheath is comprised only of one or more of: (a) polyethylene; (b) other materials made only of hydrocarbons; or (c) other fully-recyclable materials. The sheath and the elastic core can be recycled together without separation and while maintaining tensile properties of the original yarn in the fully-recyclable yarn.

Both the elastic core and the sheath can include thermoplastic. The thermoplastic can include an olefin block copolymer. In some embodiments, neither the polyethylene nor the olefin block polymer when it is present, is cross-linked.

The one or more of materials made from hydrocarbon of the elastic core can include one or more materials made only from hydrocarbons. At least one of the elastic core or the sheath can include at least one of: (a) a low density polyethylene (LDPE); (b) a linear low density polyethylene (LLDPE); (c) a medium density polyethylene (MDPE); (d) a high density polyethylene (HDPE); (e) an ultra-high molecular weight polyethylene (UHMWPE); (f) an olefin block copolymer (OBC); or (g) a blend of any of the same. Such a blend can be in any combination and/or any variation of amounts.

The yarn can include one or more of the following properties: (i) high tensile strength (e.g., approximately in the range of about 0.3 GPa to about 1.5 GPa); (ii) elastic recovery (e.g., approximately in the range of about 90% stretch deformation to about 100% stretch deformation); and/or (iii) auxetic behavior (e.g., with a negative Poisson ratio approximately in a range from about −0.1 to about −20). Another non-limiting property it can include is strong resistance to environmental degradation.

In some embodiments, the yarn can be fully-recyclable either mechanically or chemically while maintaining a tensile strength of the original yarn in the fully-recyclable yarn. In some other embodiments, the yarn can be fully-recyclable both mechanically and chemically while maintaining a tensile strength of the original yarn in the fully-recyclable yarn.

A method of manufacturing a textile can include manufacturing a garment and adding one or more accessories to the garment. The garment can include the yarn described in any of the preceding paragraphs that are part of the present disclosure and/or the yarn made via the methods described in any of the preceding paragraphs that are part of the present disclosure. The method can further include recycling the garment and the one or more accessories, and manufacturing a second garment from the recycled garment and the one or more accessories.

BRIEF DESCRIPTION OF THE DRAWINGS

This disclosure will be more fully understood from the following detailed description, taken in conjunction with the accompanying drawings, in which.

DETAILED DESCRIPTION

Certain exemplary embodiments will now be described to provide an overall understanding of the principles of the structure, function, manufacture, and use of the devices and methods disclosed herein. This includes in the description and claims provided for herein. Further, one or more examples of these embodiments are illustrated in the accompanying drawings. Those skilled in the art will understand that the devices and methods specifically described herein and illustrated in the accompanying drawings are non-limiting exemplary embodiments and that the scope of the present disclosure is defined solely by the claims. The features illustrated or described in connection with one exemplary embodiment may be combined with the features of other embodiments. Such modifications and variations are intended to be included within the scope of the present disclosure. The present disclosure includes references to non-limiting, exemplary materials (e.g., fibers and yarns) formulated in conjunction with the disclosures and teachings herein, such references being to assigned letter and number combinations (e.g., A1, A2, A3, A4, B1, B2, C1, D1, E1, etc.) that were used in conjunction with arriving at the present disclosures. A person skilled in the art, in view of the present disclosures, will understand that these materials are non-limiting examples and have properties as provided for in, and/or derivable from, the present disclosures.

Sustainable textile development can require material circularity, textile stain resistance, good washability, fast drying performance, and/or the ability to derive new circular materials from bio-based sources to avoid depletion of fossil fuels. PE-based textiles can offer a significantly reduced cradle-to-grave environmental footprint by every measure, including greenhouse emissions, water usage, contamination, and/or eutrophication. However, unless fully recyclable multifunctional garments are produced, the material cycle cannot be closed, which can result in more textile waste being generated after each production-use cycle.

Figure 1A:
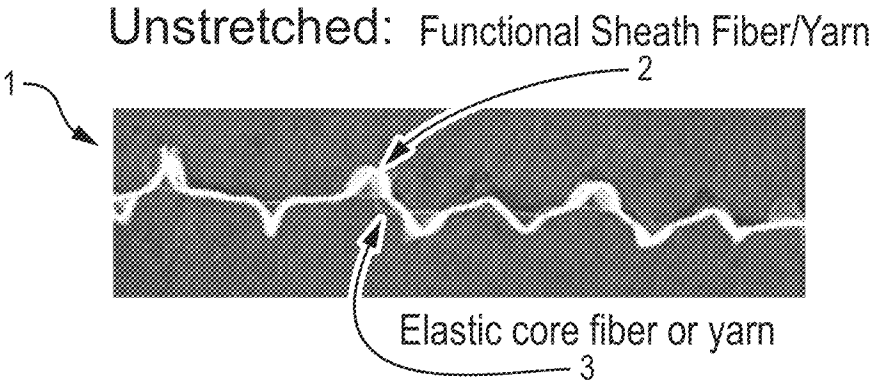
FIG. 1*a* is a photograph of a flexible composite yarn comprising an elastic core and a high-tenacity functional sheath in an unstretched configuration.
Figure 1B:
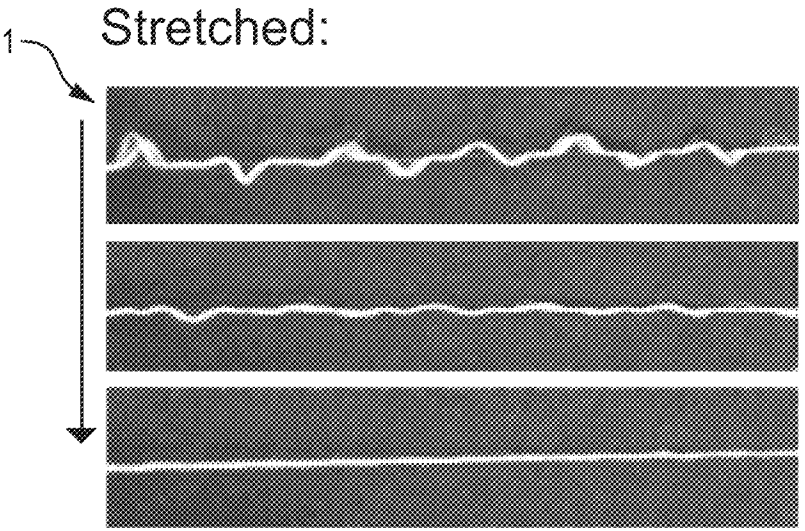
FIG. 1*b* is a top perspective view of the flexible composite yarn of FIG. 1*a* being in various uniaxially stretched configurations.

FIGS. 1*a*-1*b* illustrate an example of a complex elastic core-sheath helical mono-material yarn 1 of the present embodiments in its unstretched and uniaxially stretched configurations, respectively. As mentioned above, the elastic mono-material yarn 1 can include a composite yarn sheath 2 and elastomeric fibers (forming the composite yarn core) 3 to form a complex elastic-yet-strong monomaterial yarn. Conventional elastic yarns may typically be comprised of an elastic Spandex filament core and a functional high-tenacity multi-filament sheath yarn, e.g., polyester or nylon yarn, which results in a heterogeneous and non-recyclable yarn.

Figure 1C:
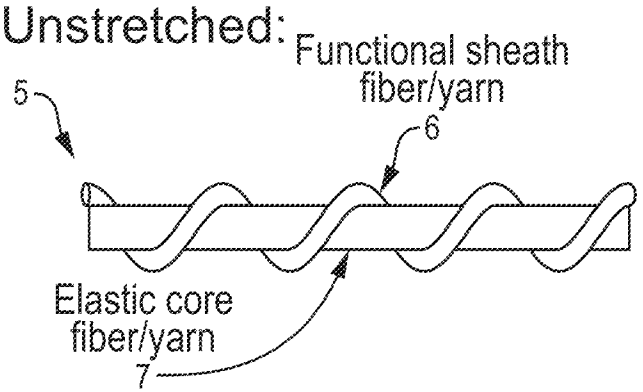
FIG. 1*c* is a schematic perspective view of an auxetic composite yarn having a thick elastic core and a thin high-stiffness sheath in an unstretched configuration.
Figure 1D:
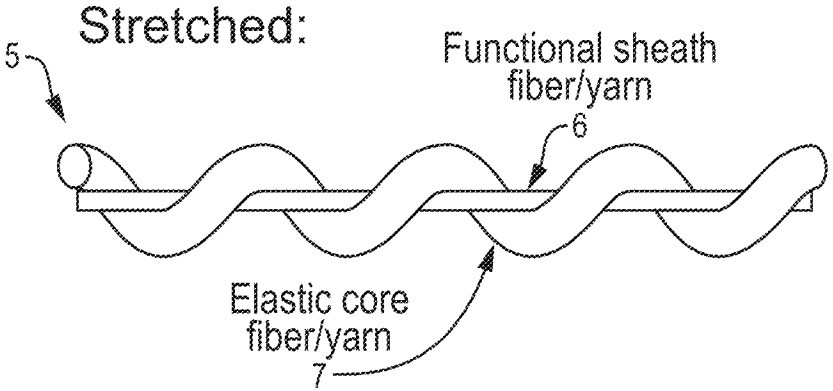
FIG. 1*d* is a schematic perspective view of the auxetic composite yarn of FIG. 1*c* being uniaxially stretched.

Another embodiment of a complex monomaterial yarn of the present embodiments can be an auxetic core-sheath helical yarn 5 shown in FIGS. 1*c*-1*d*. These yarns 5 can be made by wrapping a thinner and stiffer fiber or yarn 6 (often referred to as sheath or binder) around a thicker, softer, and more elastic core fiber or yarn 7. In both embodiments of FIGS. 1*a*-1*d*, the complex monomaterial yarn can be assembled from an elastic OBC filament core and a functional polyethylene yarn sheath made from a significantly stiffer material. Auxetic yarns 5 can be of interest for many applications in wearable and technical textiles because they can exhibit a negative Poisson ratio, i.e., when these fibers are uniaxially stretched, they can expand in the perpendicular direction to the applied force. This functionality can be achieved when the core 7 and the binder 6 swap their roles (i.e., the binder becomes the core) under uniaxial load, and the binder becomes the core of the composite yarn 5 (see FIGS. 1*c*-1*d*). Auxetic yarns can be recyclable, such as the yarns of the present embodiments, or non-recyclable, such as the yarns of the prior art, where recyclability can depend, at least in part, on the materials chosen for the softer core and/or the stiffer binder/sheath of the yarns. For example, conventional auxetic yarns have typically been heterogeneous and thus non-recyclable (e.g., comprised of a polypropylene core with Kevlar sheath or polyurethane core with nylon sheath).

Figure 2A:
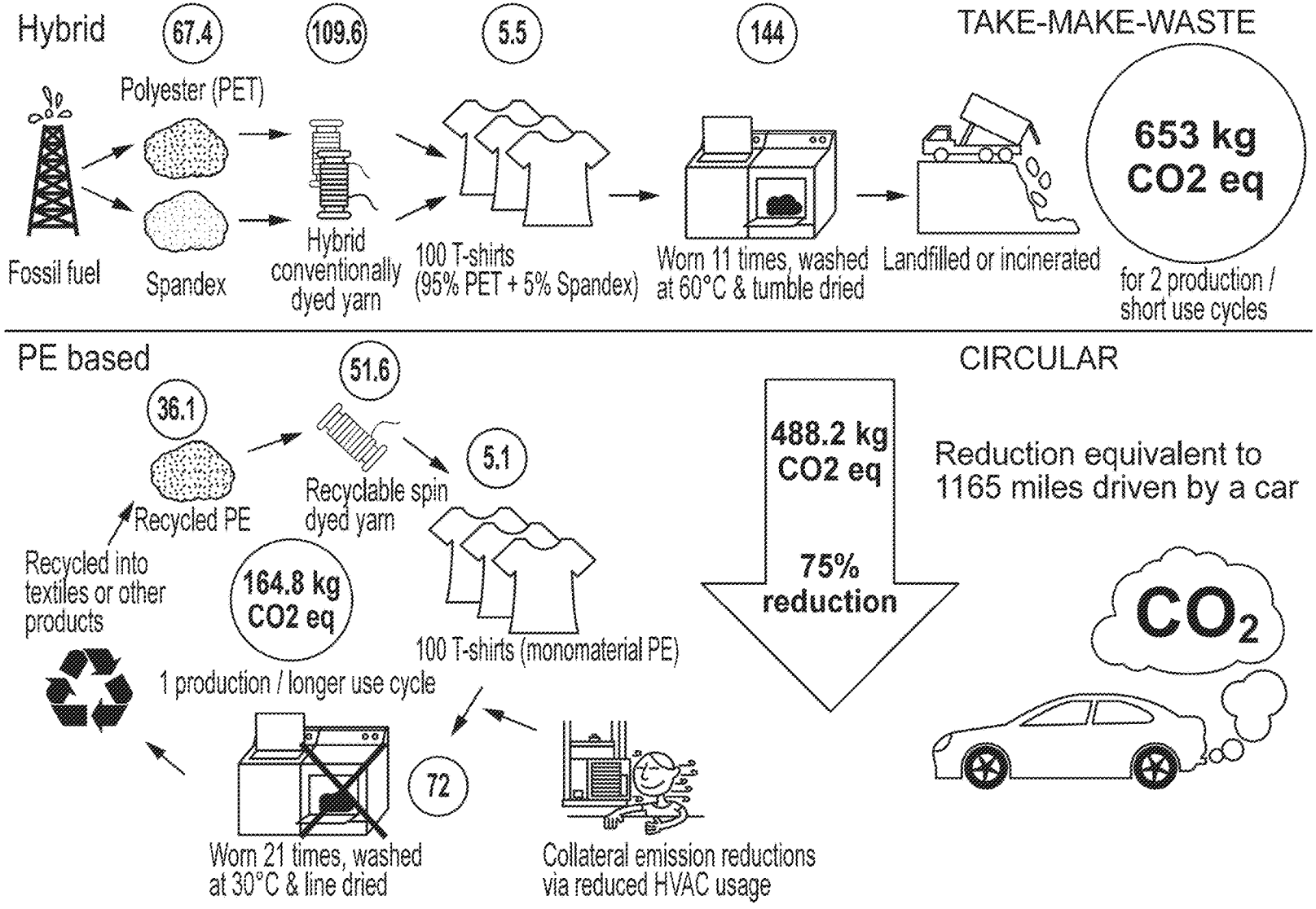
FIG. 2*a* is a schematic illustration of an estimated reduction in the cradle-to-grave carbon dioxide ($CO_2$) emission footprint of 100 T-shirts made from a fully-recyclable, stain-resistant, and elastic PE-based textile over the same number of garments made from conventional blended stretchable yarns (PET-spandex or cotton-spandex)

In the present disclosure, additional factors that may contribute to the environmental footprint reduction during the use and end-of-life phases of all-hydrocarbon PE-based textiles are evaluated, the factors including: (i) homogeneous and mechanically recyclable; (ii) stain-resistant; and (iii) fast-drying. FIG. 2*a* can predict reduction of $CO_2$ emissions during the cradle-to-grave cycle of PE-based elastic garments (in the amount equivalent to 100 T-shirts) relative to a standard type of an elastic textile composed of a polyester-spandex blend. By closing the material cycle, reducing energy usage during the production phase, and making use of the material stain resistance and fast-drying properties during the use/care phase, about 75% reduction of the $CO_2$ footprint can be predicted. Cotton-spandex blend can generate a similar $CO_2$ footprint to the polyester-spandex blend, and a significantly larger overall environmental footprint due, at least in part, to the high water usage and high-temperature processes used in cotton textile production and care.

Additional collateral emission reduction can be achieved through the passive cooling mechanism that the PE-based textiles provide, by reducing the energy consumption for the building cooling. Finally, the use of bio-derived PE resins during the first production cycle can further reduce the $CO_2$ footprint. In this case, the material phase can have a negative emission footprint (e.g., −40.9 $CO_2$ eq), yielding an about 87% overall emission reduction during the first production/use cycle even without accounting for savings on the building cooling.

Functional Polyethylene-Based Replacement for a Heterogeneous Polyester-Spandex Yarn In one exemplary embodiment provided for herein, composite yarns composed of different types of fibers can be substituted with olefin fibers, and/or other fibers, that only contain hydrocarbon monomers. Composite yarns of the prior art can be composed of an elastic spandex core and a functional polyester yarn while the mono-material yarns 1, 5 of the present disclosure can be composed of an elastic core 3, 7 composed of an olefin block copolymer (OBC) and a shell or sheath made from a functional high density polyethylene yarn (HDPE) 2, 6, among other materials provided for herein. Examples of olefin block copolymers for use as an elastic core include TAFMER® resins available from Mitsui Chemicals America, Inc. (Rye Brook, NY) (e.g., TAFMER® DF110 and TAFMER® DF605 ethylene/unsaturated olefin copolymers) and ENGAGE® and INFUSE® resins available from The Dow Chemical Company (Midland, MI). The elastic core in the yarn can be fabricated, for example, from an INFUSE® 9100 copolymer, also available from The Dow Chemical Company.

Further, as described in greater detail below, functional polyethylene yarns can be composed from LDPE, LLDPE, MDPE, HDPE, UHMWPE resins, and/or blends of the same in any combination or amounts, available from The Dow Chemical Company, Lyondell Basell (Rotterdam, Netherlands), Exxon Mobil (Irving, TX), SABIC (Riyadh, Saudi Arabia), and other synthetic resin producers, and blends of thereof. In particular, blends of polyethylene resins with a bimodal molar mass distribution can be used to spin both the elastic core fibers and the functional shell yarns, and each can be tuned to exhibit favorable properties of both low and high molar mass fractions, including a high elastic modulus and good processability, good mechanical properties, a resistance to slow crack growth, and/or an environmental stress crack resistance. Also, blends of HDPE and UHMWPE with reduced chain entanglements can be of high value for functional yarn production as known to one skilled in the art.

Figure 2B:
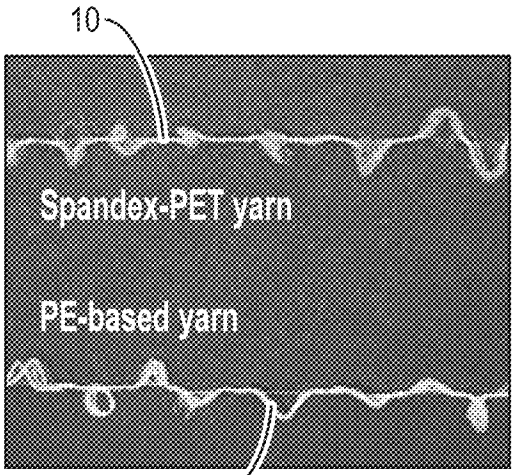
FIG. 2*b* is a photograph of a prior art commercial stretchable hybrid polyester-spandex yarn (top) and a PE-based recyclable yarn of the present embodiments (bottom)
Figure 2C:
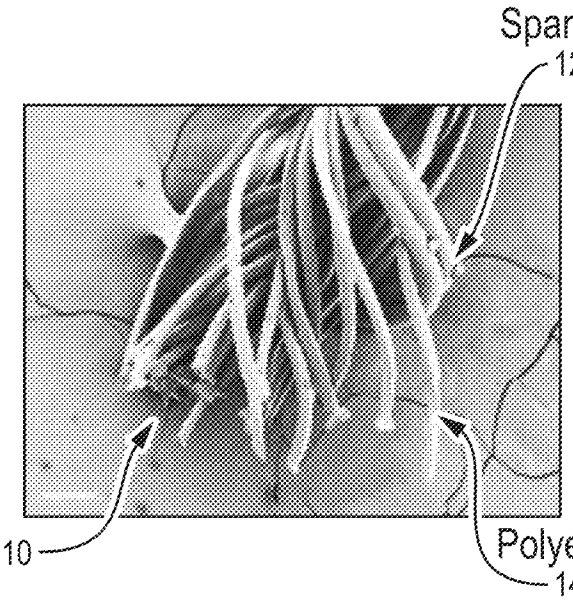
FIG. 2c (PRIOR ART)
FIG. 2*c* is a scanning electron microscopy (SEM) image of the prior art commercial stretchable hybrid polyester-spandex yarn of FIG. 2*b;*

FIG. 2*b* shows a photograph of a commercial, prior art complex core-sheath yarn 10 with elastic properties, which is comprised of a polyester-spandex blend, and an example of a new alternative PE-based fully-recyclable all-hydrocarbon yarn 20 fabricated via melt-spinning and yarn twisting techniques of the present embodiments. As used herein, reference to a material and/or yarn, etc. being "all-hydrocarbon" encompasses a material/yarn/etc. that is exclusively hydrocarbon or, to the extent non-hydrocarbon materials are included, the impact of such non-hydrocarbons is negligible such that the hydrocarbon materials still perform in the same intended manner, such as maintain the same properties (e.g., tensile strength) and remain fully-recyclable. The all-hydrocarbon core-sheath yarn 20 was spun on a commercial yarn twisting machine and contains a monofilament PE-based olefin block copolymer elastic core and a functional multifilament HDPE yarn wrapped around the core forming a helical sheath structure (see FIG. 1*b*, 1*d*, and FIG. 3). In contrast, a prior art, commercial hybrid core-sheath yarn, like the yarn 10, contains a spandex monofilament core 12 and a polyester (e.g., polyethylene terephthalate, PET) helical sheath (see FIGS. 2*b*-2*c*), making recycling of this yarn 10 difficult. These two types of fibers have been selected for a composite yarn based on their complementary mechanical properties. Further, as provided for herein, olefin (i.e., PE and OBC) fibers can be fabricated via a melt-spin process and can be engineered to exhibit a broad range of mechanical properties (see FIG. 4, discussed below). In addition to use of a standard melt-spinning process, cross-linked polymers can include additional steps for fabrication thereof. For example, cross-linked polymers may be fabricated by wet-spinning, dry-spinning, and/or melt-spinning, while adding cross-linking agents, which typically can be activated by UV light or other external stimuli. Alternatively, or additionally, X-ray or gamma irradiation can be applied after the fiber spinning process to achieve cross-linking. It will be appreciated that a monomaterial can be cross-linked, with a degree of cross-linking and polymer type possibly transforming the polymer into a thermoset, thereby causing it to lose its recyclability potential. As provided for herein, neither polyethylene nor olefin block copolymer materials of the resulting yarns are cross-linked, nor are other materials used in conjunction with and/or in lieu of polyethylene and/or olefin block copolymer materials as provided for herein. This eliminates the need for additional fiber processing steps and/or for the use of cross-linking agents, and retains the full mechanical recyclability of each fiber individually and a complex monomaterial yarns as a whole.

In particular, olefin fiber elasticity can be achieved without cross-linking the polymer, leaving the fibers and yarns amenable to mechanical recycling by melt-spinning the next generation of yarns. This can be achieved by using all-hydrocarbon olefin block co-polymers to melt-spin elastic fibers, which have soft blocks in addition to hard PE blocks in their polymer chains. To the extent existing technology makes use of olefin fibers, the fibers can be made elastic by cross-linking of polymer material during fiber manufacture. Cross-linking of olefins can be achieved chemically (e.g., by adding cross-linking agents during the melt-spinning process) or by irradiation of the spun fibers (e.g., using X-rays or gamma rays). Likewise, the melt-spun spandex fibers (sometimes referred to as "green spandex") can be typically chemically cross-linked to improve their elastic recovery rate and make them comparable to the dry-spun spandex fibers. A melt-spinning process of the fiber production can offer simple process flow, high efficiency, and eliminate the use of solvents in the production process, as well as the associated toxic emissions and spill outs. However, fibers made from cross-linked polymers may not be always recycled mechanically (especially in the case of a complex yarn recycling where they are blended together with another, non-crosslinked, polymer), which significantly reduces their "green" potential.

The yarn 20 that results from the present disclosure can be fully-recyclable, e.g., mechanically and/or chemically, and/or made of one or more of hydrocarbon polymers, including all hydrocarbon polymers (the term "all" encompassing negligible inclusion of other materials as indicated above) and/or other fully-recyclable materials of the same elemental composition as the material that comprises the elastic core. The sheath around the elastic core that can form the fully-recyclable yarn as provided for in the present disclosure allows the sheath and core to be recycled together without separation and while maintaining tensile properties of the original yarn in the fully-recyclable yarn (i.e., the yarn formed from the original yarn, the original yarn comprising one or more of hydrocarbons or other fully-recyclable materials).

Figure 3B:
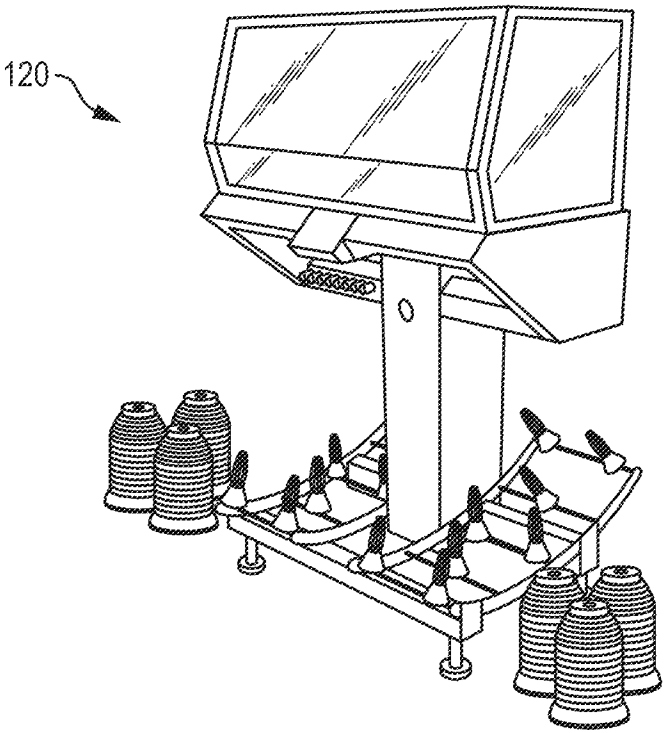
FIG. 3*b* is a photograph of a cone-to-cone multi-function DirecTwist 2C6 twisting machine (AGTEKS company) that can be used to twist the composite yarns of FIG. 3*a;*
Figure 3A:
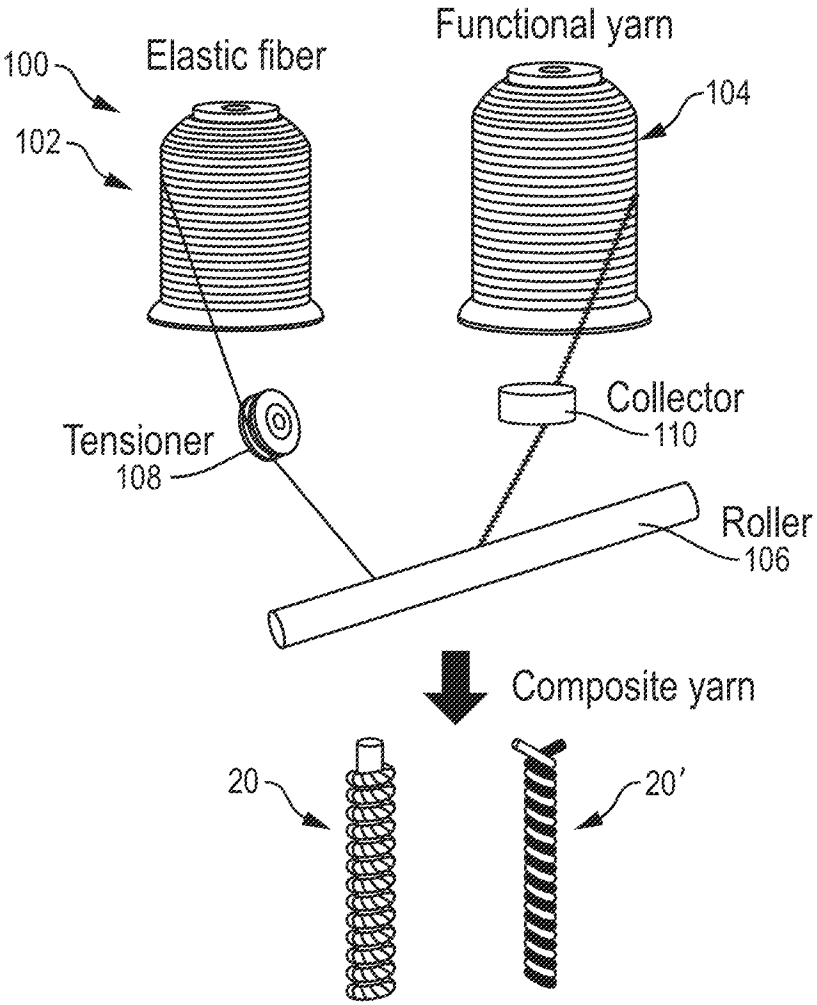
FIG. 3*a* is a schematic illustration of one embodiment of a fabrication process of an elastic core-functional sheath composite yarn.

FIG. 3*a* illustrates an exemplary embodiment of a fabrication process 100 of the all-hydrocarbon core-sheath yarn 20 of the present embodiments. As shown, the fabrication process 100 can include a roll of elastic fiber 102 and a roll of functional yarn 104 being spun onto a roller 106. In some embodiments, the elastic fiber 102 can spin over a tensioner 108 onto the roller 106, while the functional yarn 104 can spin over a collector 110. The tensioner 108 and the collector 110 can regulate the tension of the fiber and/or yarn that can be spun onto the roller 106 to prevent tangling of the fiber and/or yarn, respectively, as well as to produce complex yarn geometries with the structure shown in FIG. 1*a*, where the sheath 2 is arranged in loose loops around the core 3, allowing for the unobstructed core expansion under applied strain. The process 100 can be performed on a cone-to-cone multi-function DirecTwist 2C6 twisting machine 120 (AGTEKS company), illustrated in FIG. 3*b*, which can be used to twist the composite yarns 20.

The yarn 20 can exhibit auxetic behaviors. For example, in some embodiments, the yarn 20 can have a negative Poisson ratio approximately in a range from about −0.1 to about −20. It will be appreciated that a similar process can be used to fabricate auxetic yarns, plied yarns, and/or other types of composite "fancy" yarns. For example, as shown in FIG. 3*a*, the process 100 can yield the all-hydrocarbon core-sheath yarn 20 and/or a double-plied yarn 20'. Specifically, fancy yarns (such as e.g., helical, spiral, corkscrew, snarl, loop, gimp, diamond, knop, and bouclé yarns) can be combined from two or more individual yarns, including one or more of the following: the core; the effect; and/or the binder, and can be manufactured in multiple stages by twisting dissimilar yarns together. In some instances, the yarn fabrication process can include twisting different yarn components under different tension to produce the desired effect. In the fancy yarn twisting process, one or more effect yarn can be wrapped around a single filament or a yarn core. Another fiber or yarn can be added as a binder to secure the effect to the core.

Polyethylene: One Material, Many Functionalities

Figure 4B:
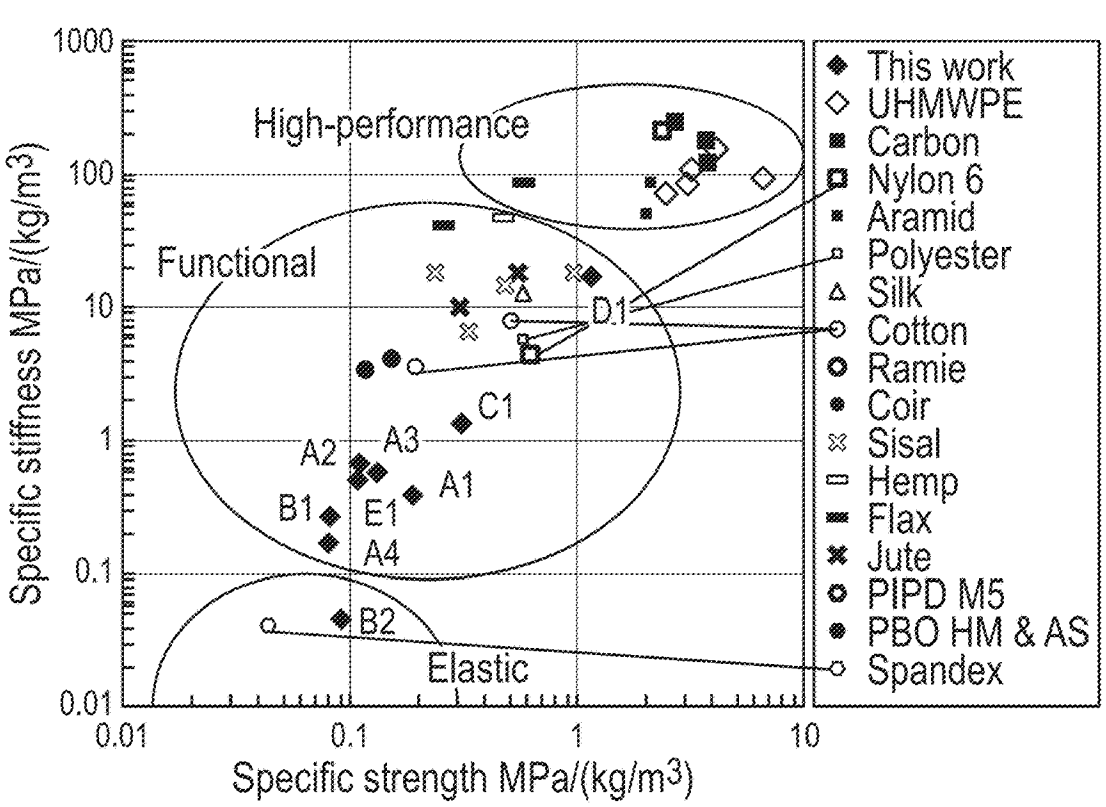
FIG. 4*b* is a strength-stiffness diagram of the properties of PE-based fibers of the present embodiments (identified as A1, A2, A3, A4, B1, B2, C1, D1, and E1, among others) as compared against the literature data for other natural and synthetic fibers.
Figure 4A:
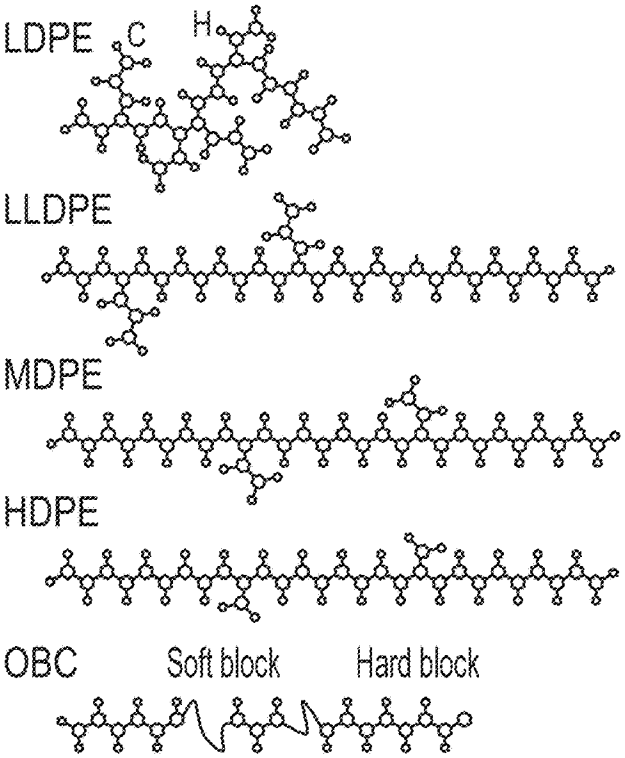
FIG. 4*a* is a schematic illustration of molecular structures of PE-based resins used for fiber spinning yarns or fibers of the present embodiments.

Continued innovation in the catalyst technology can enable synthesizing a variety of polyethylene and polyethylene-based block copolymer resins with different tensile, elastic, and/or thermal properties by engineering one or more of the length and the structure of the polymer chains comprising the polymer. FIG. 4*a* illustrates examples of a variety of polyethylene-based structures that can be used to form the polymer. For example, low density PE (LDPE) with many short branches created via intermolecular and intramolecular chain transfers during high-pressure free radical polymerization exhibits low crystallinity, low molecular weight, and low strength and stiffness, while high density PE (HDPE) catalyzed via a Ziegler-Natta or a slurry polymerization process can exhibit long chains, low branching, and much higher tensile strength (see FIGS. 4*a* and 4*b*. The solid diamond-shaped data points in FIG. 4*b* correspond to different PE-based all-hydrocarbon melt-spun fibers of the present embodiments. As shown, these fibers can exhibit the tensile and elastic properties that span the "elastic" and "functional" domains on this plot. Other conventional fibers are included in the plot for comparison, including commonly used textile fibers such as spandex, cotton, polyester, and nylon, as shown in FIG. 4*b*. Control of the polymer chain length can also allow for the synthesis of linear low density (LLDPE), medium density PE (MDPE) and ultrahigh molecular weight PE (UHMWPE) resins featuring linear polymer chains of progressively increasing length and lower branching. Finally, the implementation of one or more catalytic processes can result in successful synthesis of PE-based olefin block copolymers via a chain shuttling technology. This technology can utilize, for example, two catalysts with different monomer selectivity, enabling synthesis of linear multiblock copolymers containing alternating hard blocks exhibiting high crystallinity and soft amorphous blocks that promote polymer elasticity (see FIG. 4*a*).

Gel-spinning and electrospinning technologies allow converting synthesized UHMWPE resins into fibers with exceptional specific stiffness and strength, for instance by one or more of: controlling the degree of crystallinity; reducing the number of chain ends; and/or promoting orientation of polymer chains along the fiber axis. Gel-spun highly crystalline UHMWPE fibers exhibit high stiffness, e.g., elongation at break of only about 3%, and very high cost. On the other hand, melt-spun semi-crystalline HDPE fibers have been reported to exhibit tensile strain at break of about 84%, which is larger than conventional polyester and even nylon fibers, but much smaller than the strain-at-break values typical for elastic fibers (e.g., over about 200%, and typically in the range of about 400% to about 800%). Lower-crystallinity LLDPE fibers can be engineered to exhibit significant elongation-at-break values (up to about 208% in at least some instances). However, elastic recovery of PE fibers is typically below about 30%, unless the fibers are cross-linked, which can limit or completely eliminate a possibility to recycle them mechanically at the end of the garment lifecycle.

In FIG. 4*b*, mechanical performance characteristics of fabricated PE-based fibers of the present disclosure are plotted on the specific stiffness-specific strength diagram (solid diamonds labeled A1, A2, A3, A4, B1, B2, C1, D1, E1) and compared to those of conventional textile-grade natural (e.g., silk, cotton, ramie, coir, hemp, flax, and synthetic fibers (e.g., Nylon 6, Aramid, Polyester, spandex). As shown, the fibers can be approximately divided into elastic, functional, and high-performance categories by their tensile characteristics (note that high-performance UHMWPE fibers shown as open diamonds are typically fabricated via gel-spinning process due to high viscosity of the high-molecular weight PE resins). Unlike conventional textile fibers, which can often exhibit a narrow range of properties per one type of material, the data corresponding to the PE-based fibers with different composition and fabrication process parameters of the present disclosure span a wide range along the plot diagonal from the lower-left quadrant (typical for single-network elastomers) to the upper-right quadrant (typical for high-performance, super-stiff fibers). In particular, the B2 fiber can exhibit a Young's modulus of about 37±6 MPa, while the C1 fiber has a Young's modulus of about 1.3±0.3 GPa. For comparison, commercial spandex fibers can exhibit a Young's modulus below 10 MPa, while high-performance polyester and nylon 6 fibers can exhibit Young's moduli of about 8 GPa and about 5 GPa, respectively.

To engineer a family of PE fibers with varied mechanical properties such as those shown in FIG. 4*b* and otherwise provided for in the present disclosure, characteristics or parameters of the fibers, including the material crystallinity, polymer chains orientation, and/or intermolecular interactions, can be tailored. More specifically, these characteristics of the fibers can be controllably tuned both by the judicious choice of a PE resin (or a resin blend) type and/or by the fabrication process parameters, such as shown by FIGS. 4*b* and 4*c*. A library of PE-based fibers and yarns with properties spanning a wide range has been fabricated by melt-spinning from several types of PE-based resins (including OBC, LDPE, LLDPE, MDPE, and HDPE), as illustrated in FIGS. 4*a* and 4*b*. Different types of PE-based fibers can be characterized and compared by their thicknesses and surface morphologies, as well as by their stretchability and elastic recovery performance. Notably, the elastic all-hydrocarbon PE-based fibers used in conjunction with the present disclosures are different than the elastic PE fibers used in textiles in the prior art because elastic PE fibers in the prior art can be typically cross-linked while the elastic PE-based fibers herein are not cross-linked. Cross-linking during a melt-spin process, for example, can include one or more additional steps to manufacture when compared to the methods of the present disclosure and can render the fibers non-recyclable.

Figure 4D:
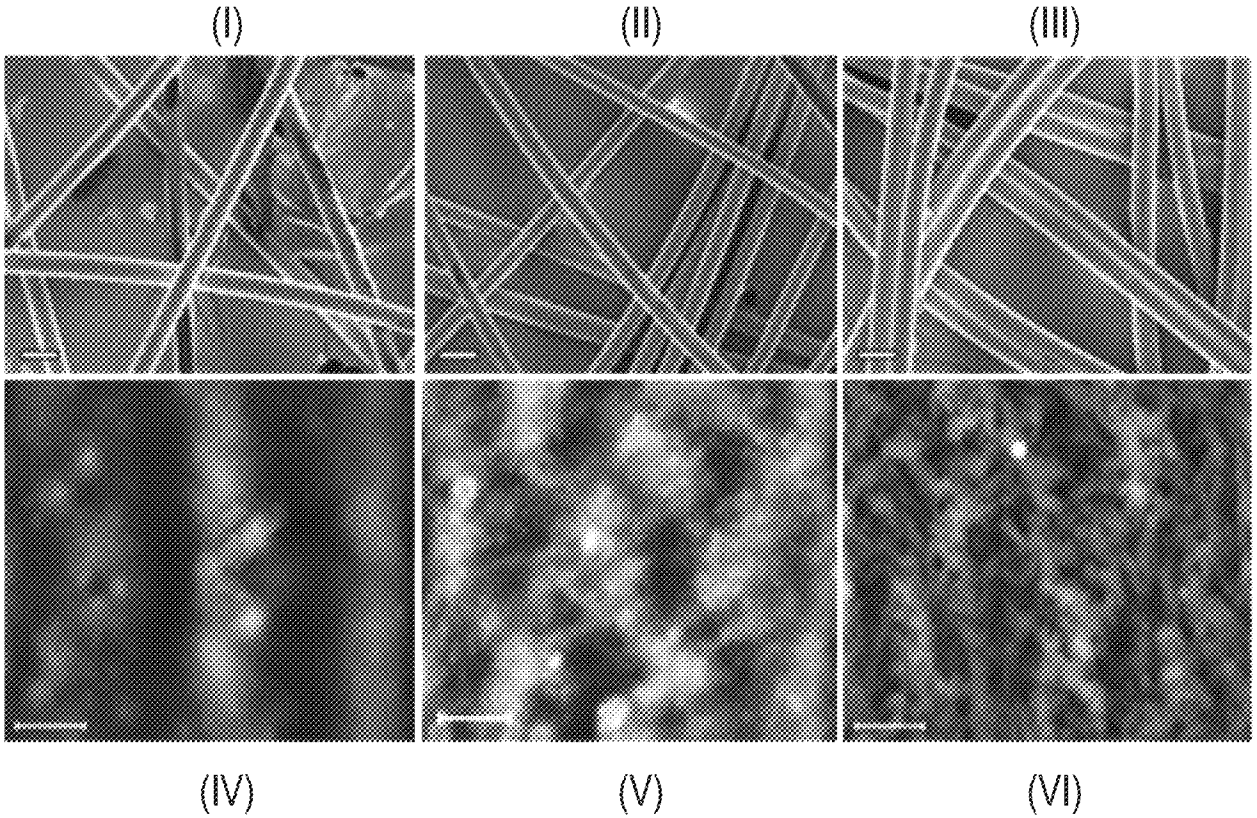
FIG. 4*d* includes SEM images and atomic force microscopy (AFM) images of the A1, A2, A3 polyethylene fibers of FIG. 4*b;*
Figure 4C:
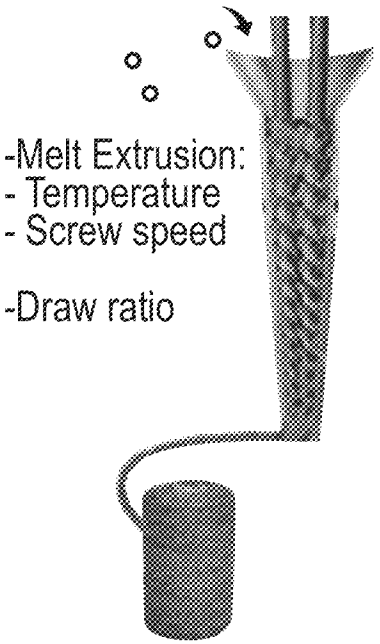
FIG. 4*c* is a schematic illustration of one embodiment of a fiber fabrication process.

FIG. 4*d* includes SEM images (I-III) and atomic force microscopy (AFM) images (IV-VI) of the A1, A2, A3 polyethylene fibers, respectively, with scale bars being 50 um for all the SEM images and 500 nm for all the AFM topology images, and the Z-scales being 100 nm for AFM images. Scanning electron microscopy (SEM) and atomic force microscopy (AFM) images of the fabricated fibers are shown in FIG. 4*d* (I-VI), which show that the fabricated fibers can exhibit circular cross-sections (with fiber diameters controlled, at least in part, by the size of a spinneret hole and the drawing speed) and smooth surfaces. For the convenience of comparison with commercial textile-grade fibers and literature data, the average diameters of fibers were chosen to fall in the range between 25 μm and 75 μm (see FIG. 4*d* (I-VI)).

Figure 5A:
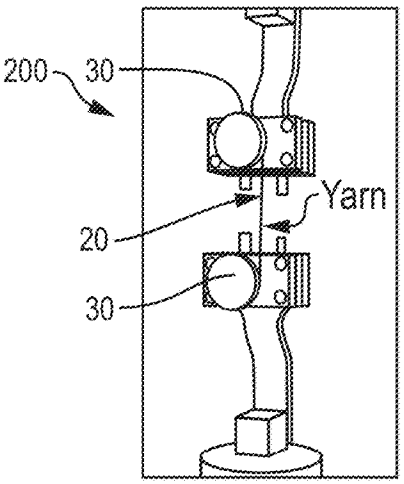
FIG. 5*a* is a side perspective view of a system for performing tensile tests used to evaluate parameters of embodiments provided for herein (e.g., PE-based fibers and yarns)

FIG. 5*a* is a side perspective view of a system 200 for performing tensile tests. The system 200 can be used to evaluate parameters of exemplary embodiments (e.g., PE-based fibers and yarns), the system including special grips (not shown) and a card frame 30 to align fibers and to prevent their slip due to low surface energy of material. Mechanical testing can show that commercial heterogeneous yarn (e.g., the yarn 10) and the PE-based all-hydrocarbon yarns (e.g., the yarn 20) can exhibit comparable mechanical performance (see FIGS. 5*a*-5*b*). The fibers chosen for the core and the sheath of the PE-based yarns can be engineered to exhibit high elastic recovery for the core and high tenacity for the sheath by a judicious combination of PE resins and the fabrication process parameters, as described in further detail herein (see FIGS. 5*c*-*f*).

Figure 5B:
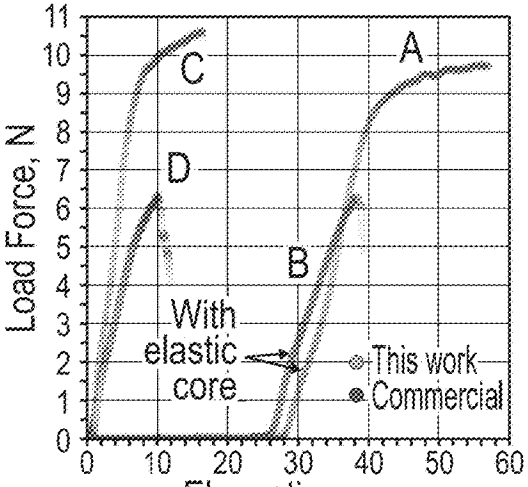
FIG. 5*b* is a graph illustrating representative engineering stress-strain curves for PE-based hybrid yarns (e.g., B2 core and C1 sheath) yarns.
Figure 5C:
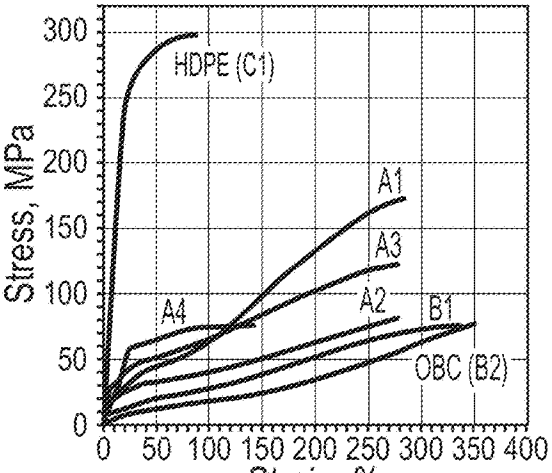
FIG. 5*c* is a graph illustrating representative engineering stress-strain curves for individual-based fibers (e.g., B2 core and C1 sheath)
Figure 5D:
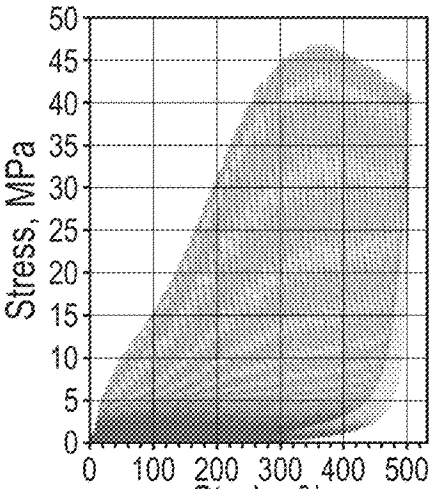
FIG. 5*d* is a graph illustrating a strain-stress curve for the cyclic loading of a C1 fiber at increasing strain levels, with amplitude of oscillations increasing stepwise by about 1 mm.
Figure 5E:
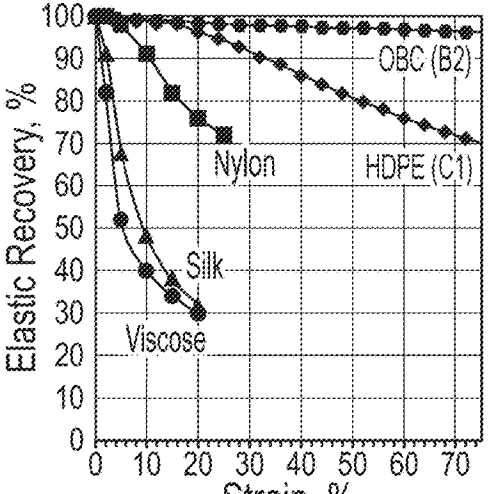
FIG. 5*e* is a graph illustrating an elastic recovery as a function of fiber elongation for a functional C1 fiber and an elastic B2 fiber as compared to equivalent curves for conventional fibers (e.g., nylon, silk, viscose)
Figure 5F:
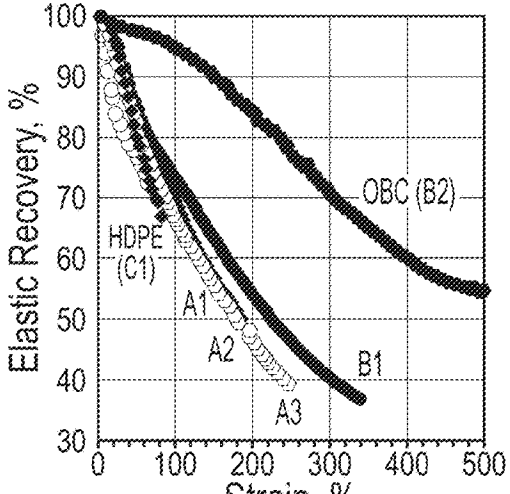
FIG. 5*f* is the graph illustrating elastic recovery as a function of fiber elongation with the data shown in a wider range of strain levels and for different types of fabricated PE-based fibers (e.g., A1, A2, A3, B1 fibers)

Tensile data of the mechanical properties of a commercial blended yarn and a new PE-based all-hydrocarbon fully recyclable yarn is plotted in FIGS. 5*b*-5*f*. FIG. 5*b* shows the data for composite stretchable yarns of the present embodiments and the commercial yarn, respectively (curve A and curve B), and for the corresponding functional sheath yarns (with removed elastic cores) of the present embodiments and the commercial yarn, respectively (curve C and curve D) separately. It can be seen that the tensile curve for the new PE-based yarn is similar to that measured for the commercial yarn as shown in FIG. 5*b*, while the PE-based yarn outperforms the commercial one in terms of strength. FIG. 5*c* shows tensile curves for different types of PE fibers, e.g., A1, A2, A3, A4, B1, B2, and C1 yarns, while FIG. 5*d* illustrates a strain-stress curve for the cyclic loading of the fiber, which can be used to measure the elastic recovery of fibers as a function of applied strain, as shown in FIG. 5*e* for viscose, silk, nylon, C1 (HDPE), and B2 (OBC), and FIG. 5*f* for A1, A2, A3, A4, B1, B2, and C1 yarns.

Figure 2D:
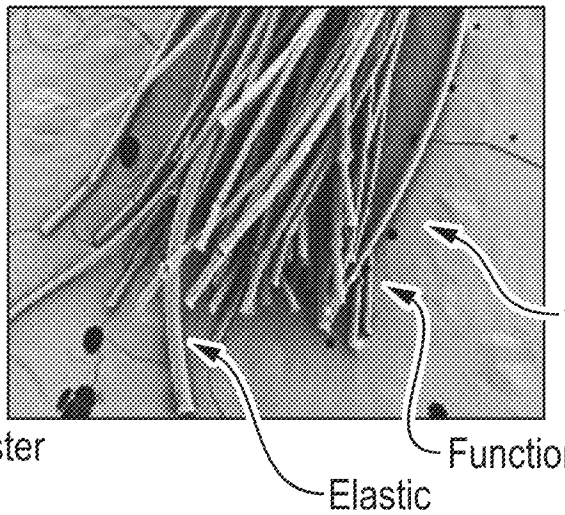
FIG. 2*d* is an SEM image of the PE-based recyclable yarn of FIG. 2*b;*

FIGS. 5*b*-5*f* illustrate that the PE fibers exhibit different elastic properties as well as different levels of elongation and strength. In particular, a B2 fiber can exhibit elongation at break about 500%, with an over 90% of recovery for elongations up to about 150%, which can be comparable with commercial spandex fibers that exhibit elongation between 480% and 550%. In turn, C1 PE fiber can have a maximum elongation of about 90%, while high-performance polyester and nylon 6 fibers can be stretched only up to about 20% and 25%, respectively. Based on this data, in some exemplary embodiments, B2 can be used as an elastic core and C1 can be used as a functional sheath to make a PE-based elastic yarn, such as the yarns 10, 110 shown in FIGS. 2*b* and 2*d*. In other non-limiting examples, composite stretchable core-sheath yarns can be formed by combining B2 as a core with an A4 yarn sheath. This combination can exhibit both a higher load force and higher elongation at break than C1 yarn, albeit at the expense of a higher yarn denier.

Figure 6A:
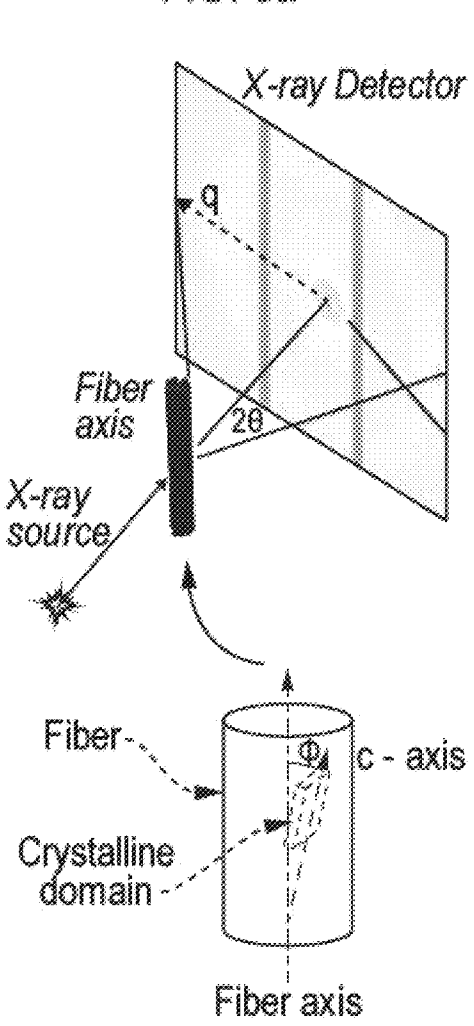
FIG. 6*a* is a graph of a schematic perspective view of an X-ray scattering experimental setup being used with a polycrystalline structure of polyethylene fibers, the rectangle representing crystalline domain in an amorphous phase of polycrystalline PE-based fibers and the c-axis being the direction of either crystalline domains or PE macromolecular chains orientation along a fiber axis.

FIG. 6*a* illustrates an exemplary embodiment of a wide-angle X-ray scattering (WAXS) technique that can quantitatively investigate the material crystallinity and orientation of crystallite domain along the drawing direction of fibers to reveal the correlation between the mechanical performance of fibers and their internal structure. WAXS spectra can show the presence of an orthorhombic phase of crystalline PE in all the fibers. Moreover, WAXS spectra can also reveal a clear difference in the fiber crystallinity level between elastic (e.g., B2) and functional (e.g., C1) fibers.

Figure 6B:
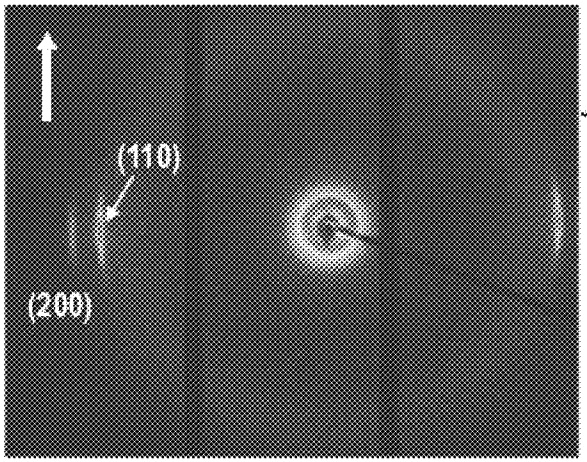
FIG. 6*b* is an image of a wide-angle X-ray scattering (WAXS) pattern for an elastic B2 fiber, illustrating characteristic Bragg scattering by plane (110) and plane (200), both planes of an orthorhombic phase of PE having been observed substantially perpendicular to the fiber axis (as shown by the arrow)
Figure 6C:
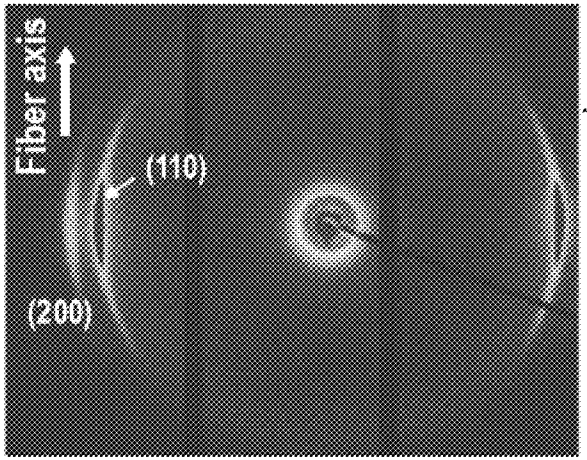
FIG. 6*c* is an image of a WAXS pattern for a functional C1 fiber, illustrating characteristic Bragg scattering by plane (110) and plane (200), both planes of orthorhombic phase of an orthorhombic phase of PE having been observed substantially perpendicular to the fiber axis (as shown by the arrow)
Figure 6D:
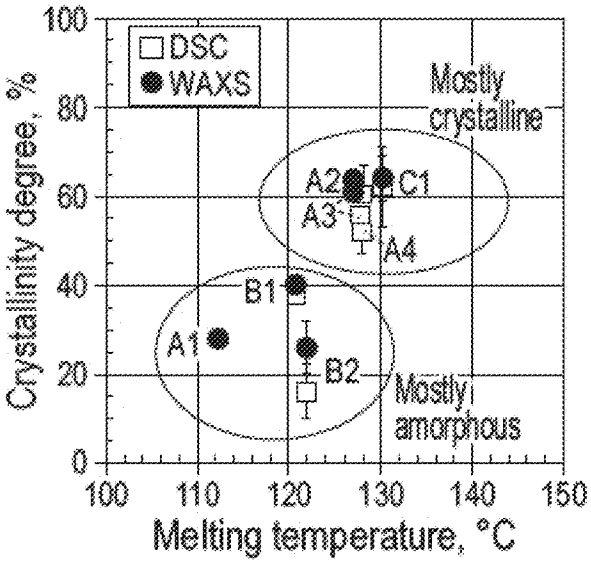
FIG. 6*d* is a graph illustrating correlations between effective crystallinity and melting temperature obtained from WAXS and differential scanning calorimetry (DSC) experiments in accordance with the present disclosures, illustrating that higher melting temperature correspond to fibers with higher crystallinity levels.

The 2D WAXS pattern for an elastic B2 fiber, as shown in FIG. 6*b*, can demonstrate low-intensity, small area diffraction peaks located at the equator, which correspond to crystal plane (110) and crystal plane (200) of the orthorhombic phase. In contrast, a similar pattern for a functional C1 fiber demonstrates high-intensity, large area peaks, which is a signature of a higher degree of fiber crystallinity, as shown in FIG. 6*c*. Another indication of lower crystallinity of B2 fiber with comparison to C1 fiber is higher intensity of a broad amorphous halo observed on at low diffraction angles on 2D patters of B2 fiber, as shown in FIGS. 6*b* and 6*c*. The presence of arc-like diffractions peaks in both B2 and C1 fibers are an indication of an alignment of crystalline domains along drawing direction of fibers.

Differential scanning calorimetry (DSC) can be used to independently measure crystallinity of the PE-based fibers. These data are shown as filled circles in FIG. 6*d* and are compared to those obtained from the fiber WAXS spectra, shown as unfilled circles in FIG. 6*d*. In general, FIGS. 6*a*-6*e* illustrates that the PE fiber crystallinity level scales with the material molecular weight and density. For example, the fiber spun from an HDPE resin (C1) exhibits the highest crystallinity values—about 74% from WAXS and about 68% from DSC, resulting in its higher melting temperature and a large effective domain volume, as shown in FIGS. 6*b*-6*c*. In contrast, the olefin block co-polymer elastic fiber (B2) can exhibit very low crystallinity and random orientation, as the soft amorphous blocks of OBC do not favor the process of crystal formation as well as the polymer chain alignment during the melt-spinning process. It is worth noting that the degree of crystallinity of fibers spun from OBC resins may be tailored, for example, by engineering the ratio of the soft and the rigid blocks in the polymer chain (see the difference between A2 and B2 OBC fibers, as an example).

Figure 6E:
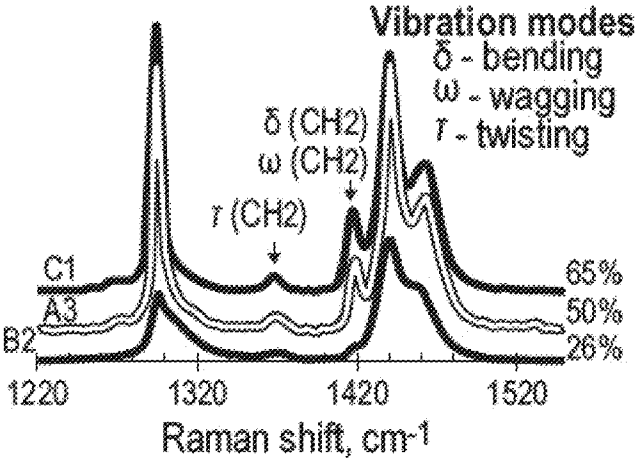
FIG. 6*e* is a graph illustrating Stokes-shifted Raman spectra of B2, A3, and C1 fibers, and the crystallinity values calculated from these spectra, which show correlations with the crystallinity values obtained from WAXS and DSC experiments shown in FIG. 6*d;*

Raman spectroscopy can provide another independent measurement of the fiber crystallinity. The Stokes-shifted Raman spectra of the three types of all-hydrocarbon fibers down-selected for the composite monomaterial yarn fabrication (B2, C1 and A3) are shown in FIG. 6*e*. The crystallinity values calculated from these spectra, 26%, 56%, and 65%, respectively, can correlate well with the crystallinity values extracted from WAXS and DSC measurements.

By comparing the data in FIGS. 4*b*, 5*b*-5*f*, and 6*b*-6*e*, it can be concluded that the higher value of strength observed in PE yarns can be attributed to their higher degree of crystallinity and better orientation of crystalline domains along the fiber axis. In turn, the reduction in the fiber crystallinity level can reduce the fiber strength, but can improve its elasticity, namely elongation at break and elastic recovery. For example, the elastic recovery at about 70% fiber elongation level is about 97% for a largely amorphous and non-oriented B2 fiber and only about 70% for the functional mostly crystalline C1 fiber with a moderate level of domain orientation along the fiber axis. Note that the C1 fiber can still outperforms nylon, viscose, and silk fibers on this measure, as shown at least in FIG. 5*e*.

Effective diameters of olefin monofilaments used to construct complex hierarchical yarns can vary from hundreds of nanometers to centimeters. A cross-sectional shape of monofilament can vary from circular, polygon-like, ellipse, square, rectangle, triangular, rounded triangular, trilobal, cross-like, kidney bean to fractal-like. Further, monofilaments can contain hollow inhomogeneities distributed either periodically or randomly across the monofilament cross-sectional area or its selected section (the selected section area can also have different shapes). For example, hollow inhomogeneities can form a core with circular cross-sectional shape inside a polyethylene monofilament (fabricated via melt extrusion process).

To further extend the range of properties of the new functional fibers, their surface properties can be modified, for example via plasma treatment, illumination, and/or their cross-sectional and along-the-filament shapes via thermal and mechanical texturing. This can allow for production of thick-and-thin, crimped, looped, and/or curled mono-material yarns with increased bulkiness, variable luster, and/or improved thermal insulation properties without using staple fibers that are the main source of textile-caused microfiber pollution.

The fabrication process of the mono-material fibers can be further extended to fabrication of melt-spinning bi-component or tri-component fibers and yarns, composed, for example, of olefins with the same chemical composition but different tacticity, molecular weight, and/or crystallinity levels. For example, one or more of the elastic core or the sheath can be a single component fiber, a bi-component fiber, and/or a tri-component fiber. These multi-component fibers may include, but are not limited to, a core-sheath fiber type, a side-by-side fiber type, and/or an islands-in-the sea fiber type, which are known to one skilled in the art. Bi-component mono-material fiber production allows for extending the range of fiber properties and functionalities to include, for example: (i) temperature-activated self-bulking and self-twisting fibers (by co-spinning polymers with different strain level or shrinkage propensity); (ii) strong-yet-soft fibers (with a high-crystallinity high-tenacity core and an elastic amorphous sheath); (iii) auxetic fibers; and/or (iv) light-guiding fibers for dye- and pigment-free colored and re-configurable photonic textiles (with optically-transparent amorphous cores), etc.

Recycling and Upcycling of the Composite PE-Based Yarns

Studies to assess the viability of the properties of the recycled fibers based on the PE blends of the disclosures and related formulations provided for herein can be performed to determine if such fibers can achieve material circularity and to select polymer blends that do not degrade the recycled fiber properties. Accordingly, to assess the viability of close-loop recycling of composite polyethylene-based textiles, the tensile properties of mechanically recycled fibers spun from the blends of PE-based materials used in production of flexible core-sheath yarns was analyzed in detail. MDPE and OBC blends were chosen for the present disclosure, but HDPE-OBC and UHMWPE-OBC blends can similarly yield enhanced recycled fiber properties.

Figure 7A:
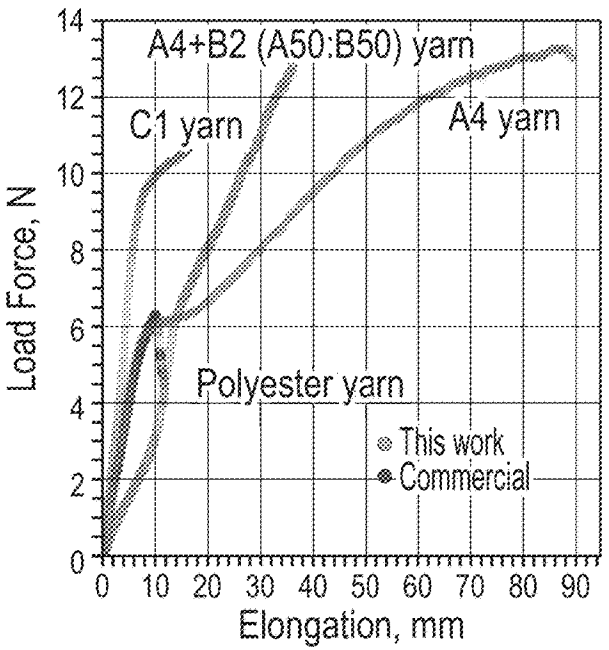
FIG. 7*a* is a graph illustrating stress-strain curves for A4 and C1 yarns compared to those of a commercial polyester yarn and a yarn made from a 50-50% blend of the PE resin comprising an A4 yarn sheath and an olefin block copolymer (OBC) resin comprising a B2 core of a composite stretchable yarn.
Figure 7B:
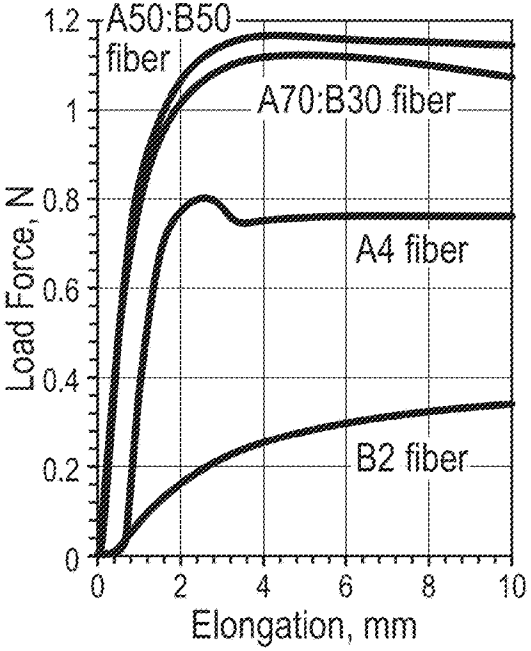
FIG. 7*b* is a graph illustrating stress-strain curves of individual monofilament fibers spun under the same processing conditions from A4 (MDPE) and B2 (OBC) resins in different ratios (e.g., 100% OBC resin, 100% MDPE resin, 70% MDPE resin and 30% OBC resin, and a 50/50 blend of MDPE and OBC resins)
Figure 7C:
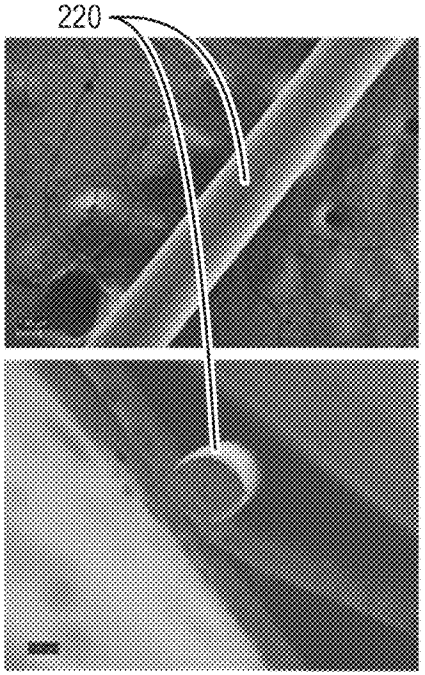
FIG. 7*c* are two SEM images of A50:B50 monofilament fibers.

As mechanical recycling of the core-sheath elastic yarns can lead to blending of OBC and MDPE or HDPE resins in the recycled plastic, a series of fibers and yarns from OBC and MDPE materials blended in different ratios can be spun. The results of mechanical testing of these yarns and fibers are shown in FIGS. 7*a* and 7*b*, respectively. FIG. 7*a* shows that a 72-filament yarn spun from an OBC and MDPE resins, blended in equal ratios (A50:B50), can exhibit a comparable breaking force and higher stiffness than the 72-filament A4 yarn made exclusively from an MDPE resin (i.e., with a 100/0 ratio of the two resins). Likewise, FIG. 7*b* shows that monofilament fibers spun from a blend of MDPE and OBC can have improved tensile properties over both monofilament unblended B2 and A4 fibers spun under the same conditions. FIG. 7*c* shows SEM images of an A50:B50 fiber 220 that can exhibit a smooth surface and cross-section. The miscibility of the two polymers even at such high blending ratio of each component has been confirmed by a DSC thermogram.

Figure 7E:
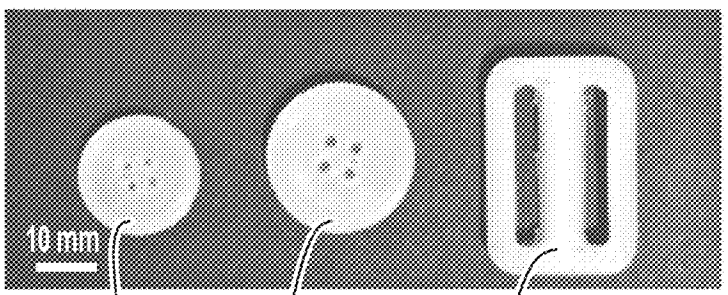
FIG. 7*e* is an SEM image of various exemplary embodiments of accessories that can be fabricated by melt-spinning followed up by Fused Deposition Modeling (FDM) 3D printing from PE resins and their blends.
Figure 7D:
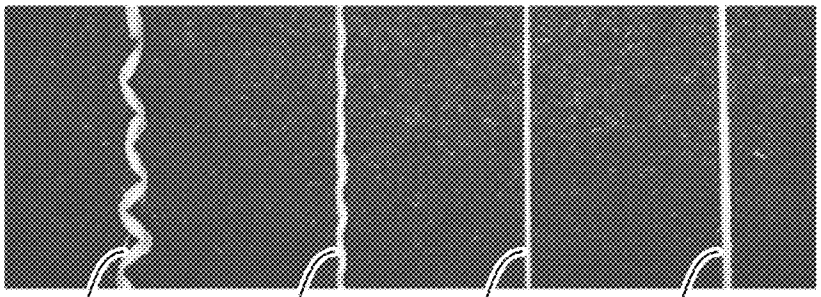
FIG. 7*d* is an SEM image of various exemplary embodiments of textile yarns that can be fabricated by melt-spinning from PE resins and their blends.

The data in FIGS. 7*a* and 7*b*, and the related images from FIG. 7*c*, illustrate the viability of the present disclosure to engineering fully recyclable, all-hydrocarbon textiles and garments by using only PE-based polymer resins. At the end of their lifecycle, the elastic all-PE garments can be mechanically recycled without separating the elastic core from the functional sheath. The resulting polymer blend can also be balanced to achieve the optimum ratio of the two polymers by adding some amount of virgin or recycled resins of either type. Elastic OBC core can similarly be co-recycled with a higher molecular weight HDPE (or even UHMWPE) material comprising a functional yarn sheath, although the optimum ratio of the blended PE-based resins can be different in each case. Other types of plied, bulky, and/or fancy yarns can be fabricated by combining different types of PE-based fibers to achieve the desired combination of strength, elongation, softness, bulkiness, etc. of the textile. FIG. 7*d* shows a few, non-limiting illustrative examples of different yarns, including (right to left) an untwisted MDPE/OBC blended yarn 320 as well as twisted yarn 420, a composite core-sheath yarn 520, and a coiled MDPE yarn 620.

Figure 8B:
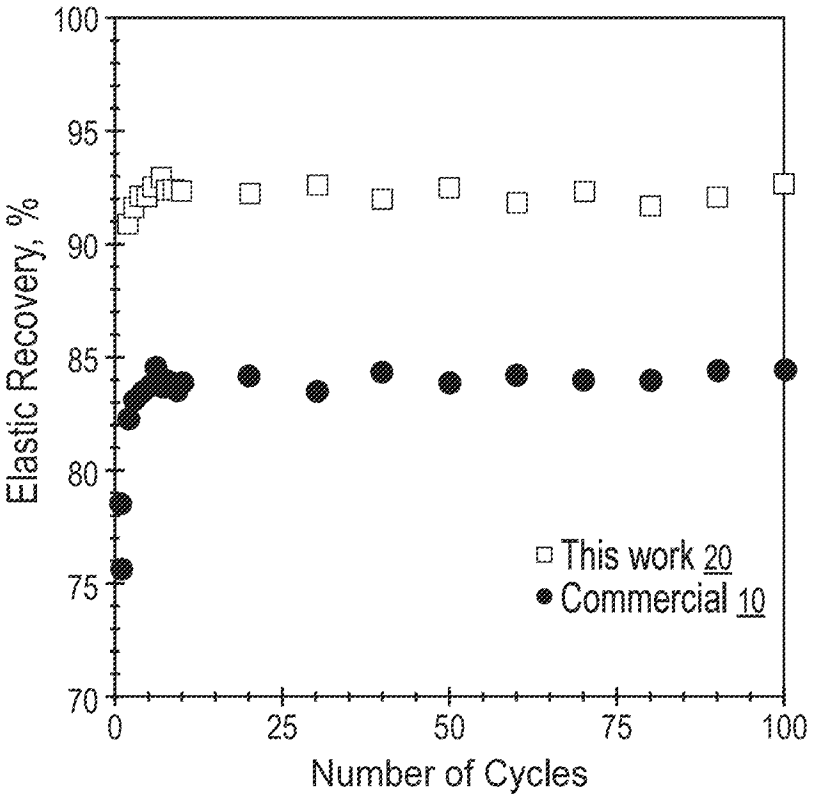
FIG. 8*b* is a graph illustrating an elastic recovery (in %) of the monomaterial elastic yarn as compared to corresponding elastic recovery characteristics for the commercial spandex-polyester yarn.
Figure 8A:
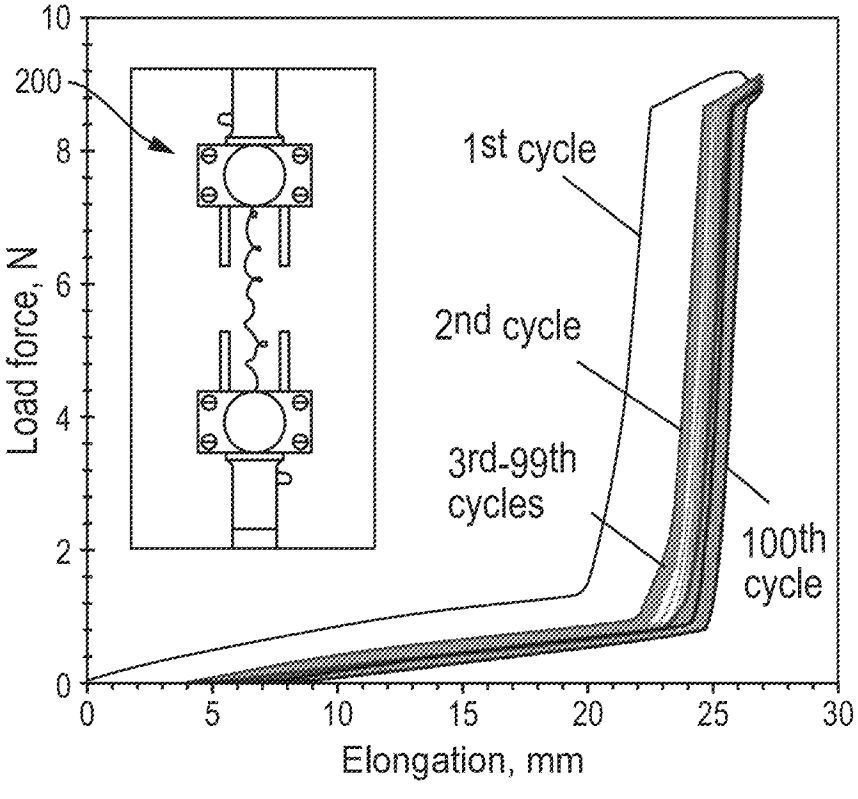
FIG. 8*a* is a graph illustrating a strain-stress curve for the cyclic loading of 30 monomaterial elastic yarns assembled in a bundle, each having an elastic B2 fiber core and a functional C1 yarn sheath.

FIGS. 8*a* and 8*b* illustrate the results of the cyclic testing of a monomaterial (B2 core and C1 sheath) yarn 3, 7, 20 made of the present embodiments and a commercial heteromaterial yarn 10. Both yarns have been stretched one hundred times and their elastic recovery can be measured in each cycle. The inset (I) illustrates one clastic yarn fixed in the grips of the system 200 of FIG. 5*a* for performing tensile tests. As shown, the yarns 20 can have an initial gauge lengths of approximately 50 mm and are tested at a constant strain level in each cycle, with a fixed elongation of approximately 27 mm, a strain rate of approximately 85 mm/min, and a preload force of approximately 40 mN. The data illustrate that the yarns of the present embodiments 20 out-perform commercial yarns 10 in terms of elastic recovery. For example, FIG. 8*b* illustrates an elastic recovery (in %) of the monomaterial elastic yarn 3, 7, 20 calculated as Elastic recovery=(elastic extension/total extension)*100%, where the total extension is measured from the yarn length at the start of each consecutive cycle. The performance of the yarn 20 can be further optimized by cold-drawing the elastic core prior to twisting the core and the sheath together, which will avoid the initial drop in elastic recovery after the first cycle. The yarns 20 in FIGS. 8*a* and 8*b* can be melt-spun without the follow-up cold drawing step, so the first couple of cycles in the testing process can effectively play the same role as the cold-drawing step, typically included in the industrial fiber melt-spinning process.

Further, fashion accessories can be fabricated from either MDPE, HDPE, and/or (H) MDPE-OBC blends and recycled together with the rest of the garment without separation. These include buckles, zippers, buttons, hooks, etc., which can be fabricated by injection or compression molding as well as by 3D printing, such as via fusion deposition modeling (FDM) technique. A person skilled in the art will appreciate other 3D printing techniques are also possible for producing such fashion accessories and related garments. FIG. 7*e* shows examples of fashion accessories 3D printed from a blend of OBC and MDPE resins, including a button 750, a button 850, and a buckle 950 (A50:B50, see Methods section below).

The results of testing performed in conjunction with the present disclosures illustrate that PE fibers can be engineered to exhibit mechanical properties spanning the range from the values typical for single-network elastomers (such as, e.g., spandex) to high-performance fibers, such as, e.g., polyester and nylon. Even further, fiber strength enhancement can be achieved by blending HDPE, OBC, and/or MDPE resins with a small amount of UHMWPE material. For example, a monofilament fiber labeled as D1 in FIG. 4*b* can have been melt-spun from a blend of 90% of HDPE and 10% of UHMWPE materials and exhibits tensile strength exceeding that of nylon and high-performance polyester. Similar reinforcement can be achieved for plastic materials fabricated from optimized HDPE-UHMWPE and OBC-UHMWPE blends, formed, for example, by injection- or compression-molding. These results demonstrate feasibility of low-cost, large-scale fabrication of PE-based fibers with a wide range of mechanical performance and smooth fiber surfaces, allowing for the manufacture of all-hydrocarbon high-performance sustainable textiles due to engineering of the PE-based fibers and yarns. Variable cross-sectional shapes of PE-based fibers can also be easily engineered during the same melt-spin fabrication process.

The molecular mechanism behind enhanced performance of blended all-hydrocarbon resins that are blends of polymers with different molecular weight can be based on the catalytic role played by the longest chains in the melt. During the flow-induced crystallization in the process of fiber melt-spinning, these long chains can recruit other chains adjacent to them into the formation of a highly oriented crystalline morphology, which can be referred to as shish-kebab. This morphology exhibits threadlike cores encircled with plate-like lamellar crystals, with the longest chains playing the central role in the structure formation. However, during the flow-induced crystallization, shorter molecular chains in the immediate vicinity of the longer chains can attach to the surface of the shish and can contribute to the flow-induced orientation of the polymer crystalline structure. As a result, crystal structure formation can involve polymer chains of different lengths, which can result in the enhancement of the mechanical properties of the blended fibers, as shown, for example, in FIGS. 7*a* and 7*b*, and offer more opportunities to further expand the diversity of tensile properties of all-hydrocarbon fibers for circular textile economy.

To further extend the range of properties of the new functional polyethylene-based fibers, their surface properties can be modified, for example, via plasma treatment and/or UV illumination, and their cross-sectional and along-the-filament geometries can be further tailored via thermal and/or mechanical texturing. This can allow for production of thick-and-thin, crimped, looped, and/or curled monomaterial yarns with increased bulkiness, variable luster, and improved thermal insulation properties without using staple fibers that are the main source of textile-caused microfiber pollution. Some such examples are illustrated by way of the yarns 320, 420, 520, and 620 of FIG. 7*d*.

The all-hydrocarbon PE-based core-sheath elastic yarn demonstrated in conjunction with the present disclosure can be an example of a spiral "fancy" yarn, which typically combines a soft and bulky strand spiraling around a fine strand, which may or may not have elastic properties. Other types of all-hydrocarbon sustainable fancy yarns can be constructed from the different types of fibers, for example as demonstrated in conjunction with the present disclosure. These include corkscrew yarns (e.g., with a fine strand spiraling around a soft and bulky strand), gimp and ratiné yarns with a slightly wavy appearance, boucle, and loop yarns, etc. Fancy yarns (albeit typically made from filaments of different materials) can be widely used in both woven and knit fabrics, for wearables, interior furnishings and specialty textiles, and the present disclosures offer a new way to create sustainable fully recyclable fancy yarns for many application areas.

The all-hydrocarbon PE-based textile yarns demonstrated in conjunction with the present disclosure can be useful in addressing the challenges of the textile circularity, for example by providing an upstream solution applied at the production (rather than end-of-life management) phase and enabling closed-loop recycling. The recycled products have already established great market value, allowing to achieve additional reduction in the environmental footprint of textiles and garments and preventing depletion of fossil fuels. Durable and lightweight, hydrocarbon polymers already account for more than half the plastics production of the world, and different PE-based products are curbside-recyclable by most facilities. By including high-performance textiles into the category of polymer-based products that are fully-recyclable through a well-established waste-management pipeline, the technology disclosed herein can offer a solution to closing the elusive material loop in the textile and fashion industry. Using bio-derived PE resins during the first production cycle can help to further reduce the environmental footprint of the textiles. Further, in addition to enabling a close-loop textile circularity, waste hydrocarbons recovered from the all-PE textile products enabled by the present disclosure can serve as a renewable feedstock for the synthesis of new virgin high molar mass hydrocarbon materials, contributing to a global circular economy development.

Methods

Fabrication of PE Fibers and Yarns

The polyethylene fibers and yarns provided for or otherwise derivable from the present disclosures can be fabricated by the fiber melt spinning process from (linear) low density polyethylene (LDPE or LLDPE), medium density polyethylene (MDPE), high density polyethylene (HDPE), ultra-high molecular weight polyethylene (UHMWPE), and/or olefin block co-polymers (OBC), such as those provided by The Dow Chemical Company. The monofilament fibers of varying diameters can be fabricated, for example, by an Xplore microcompounder and/or a Randcastle extruder, RCP-0500 model. In conjunction with the present disclosures, these actions were performed at the Fabric Discovery Center (FDC), University of Massachusetts Lowell (MA) and at the Institute for Soldier Nanotechnologies, MIT (Cambridge, MA). The multi-filament MDPE or HDPE yarns utilized in the present disclosure can be fabricated, for example, on a Hills BRD extruder, such as ones provided at the Hills Inc. (Melbourne, FL), or on an industrial-scale melt-spin extruder used by textile mills. In some non-limiting embodiments, the HDPE yarn (C1) can be composed of 45 individual filaments of about 32.4 micron diameter, MDPE (A4) and MDPE+OBC (A50:B50) yarns can be composed of 72 individual filaments each with fiber diameters of about 44.7 and about 50 microns, respectively. A person skilled in the art will appreciate other amounts of filaments and fibers, and other diameters of filaments fibers are also possible. The numbers provided for herein can only represent numbers used in some non-limiting tests and formulations.

Core-Sheath Yarns Construction and Manufacture

The PE-based core-sheath elastic yarn can be fabricated, for example, on a yarn twister (e.g., DirecTwist, 2C6/D6 Hybrid, with Servo Feeder, Agteks, see FIGS. 3*a*-3*b*). In conjunction with the present disclosures, these actions were performed at the FDC, University of Massachusetts Lowell. The elastic core monofilament can be melt-spun, for example from the INFUSE® 9100 polyethylene-based olefin block copolymer resin provided by The Dow Chemical Company. The elastic OBC core can have a diameter of about 73 micron (about 34 denier) and can be elongated about two-fold, for example using a tensioner and a yarn guide. It can then be twisted, for example with either a multi-filament HDPE yarn (C1) or a multi-filament MDPE yarn (A4), which can be fed, without tension, to form core-sheath yarns 20, 120 of the type shown in FIGS. 1*a*, 2*b*, and 2*d*. Upon releasing the loading tension, the elastic core filament can be retracted to its original length, which can lead to the formation of a helical sheath around the core.

Commercial core-sheath hybrid yarns used in conjunction with these disclosures included Sorbtek® yarn. The Sorbtek® core-sheath yarn can be composed of a 150-denier, 34 filament polyester yarn wrapped around a 20-denier monofilament spandex core with a Z twist. It was estimated via SEM imaging that the polyester filaments composing the sheath yarn have effective diameters of about 22 micron and elastic spandex core has an effective diameter of about 304 micron.

Structural and Surface Characterization of Fibers

The dimensions and surface morphology of the fibers can be characterized using SEM and/or AFM techniques. In conjunction with the present disclosures, SEM images were obtained using a Zeiss (300 Sigma VP model) microscope at a 3 kV accelerating voltage. A DESK IV Cold sputter can be used to apply an eight (8) nm thick gold coating to all fibers prior to the SEM experiment. To obtain cross-sectional view, fibers can be mounted on a 90-degree angled SEM sample stub and cut with an industrial razor blade from VWR® (Radnor, PA) prior to being coated with gold. The average diameter of PE fibers can be determined from the distribution of diameters of over 50 fibers per sample measured using ImageJ software from the National Institutes of Health (Bethesda, MD). The fine surface morphology of PE fibers can be characterized by a Bruker Dimension (Billerica, MA) 3100 AFM microscope at ambient conditions with a scan rate in the range of about 0.2 Hz to about 0.5 Hz. A RTESPA-150 AFM probe from Bruker Dimension with estimated tip radius of about 8 nm can be used.

Fiber Mechanical Properties Characterization

The mechanical properties of fibers can be measured, for example, using a Zwick tensile test machine equipped with a temperature chamber. The load force can be measured as a function of the fiber elongation under uniaxial tension. In conjunction with the present disclosures, a gauge length of about 25 mm was used, and a constant-rate-of-extension can be about 15 mm/min. The Young's modulus for each fiber can be determined, for example, from the slope of linear regression in the region of small strain.

Fiber Crystallinity and Polymer Chain Orientation Characterization

The fiber crystallinity and orientation of crystalline domain can be evaluated, for example, using a WAXS system with Rigaku 002 microfocus X-ray source and DECTRIS PILATUS 300K detector. The degree of crystallinity can be quantified, for example, as ratio of area of all crystalline peaks to the total area under the X-ray scattering curve. Thermal properties of fibers can be characterized, for example, by using differential scanning calorimetry (DSC). DSC data can be obtained using, for example, a calorimeter model Discovery from TA Instruments (Wakefield, MA). Heating-cooling-heating cycles can be performed in some instances approximately in the range of temperatures from about −40° C. to about 180° C. with nitrogen (purged rate can be about 50 ml/min). The heating and cooling rates can be about 10° C./min in some instances. Because the thermal history of a polymer can affect the DSC data, all samples can be evaluated both "as received" (cycle #1) and after being subjected to a common "thermal treatment" (cycle #2).

Examples of the above-described embodiments can include the following:

1. A yarn, comprising:
   an elastic core comprised only of one or more of materials made from hydrocarbons or other fully-recyclable materials; and
   a sheath comprised only of one or more of polyethylene, other materials made only of hydrocarbons, or other fully-recyclable materials,
   wherein the yarn is fully-recyclable and made only of one or more of hydrocarbon polymers or other fully-recyclable materials of the same elemental composition as the one or more of materials of the elastic core.
2. The yarn of example 1, wherein both the elastic core and the sheath comprises thermoplastic.
3. The yarn of example 1 or 2,
   wherein the one or more of materials made from hydrocarbons comprises one or more materials made only from hydrocarbons, and
   wherein the hydrocarbon polymers comprise all-hydrocarbon polymers.
4. The yarn of any of examples 1 to 3, wherein at least one of the elastic core or the sheath comprises at least one of single component fiber, bi-component fiber, or tri-component fiber.
5. The yarn of example 4, wherein the at least one of single component fiber, bi-component fiber, or tri-component fiber comprises at least one of a core-sheath fiber type, a side-by-side fiber type, or an islands-in-the sea fiber type.
6. The yarn of any of examples 1 to 5, wherein at least one of the elastic core or the sheath comprises at least one of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same.
7. The yarn of any of examples 1 to 6, wherein neither the polyethylene nor the olefin block copolymer when it is present, is cross-linked.
8. The yarn of any of examples 1 to 7, wherein the yarn comprises one or more of the following properties:
   (i) high tensile strength approximately in the range of about 0.3 GPa to about 1.5 GPa; or
   (ii) elastic recovery approximately in the range of about 90% stretch deformation to about 100% stretch deformation.
9. The yarn of any of examples 1 to 8, wherein the yarn exhibits an auxetic behavior with a negative Poisson ratio approximately in a range from about −0.1 to about −20.
10. The yarn of any of examples 1 to 9, wherein the yarn is fully-recyclable either mechanically or chemically while maintaining a tensile strength of the original yarn in a recycled yarn.
11. The yarn of any of examples 1 to 9, wherein the yarn is fully-recyclable both mechanically and chemically while maintaining a tensile strength of the original yarn in a recycled yarn.
12. The yarn of any of examples 1 to 11, wherein the yarn is formed via a melt-spin process.
13. A textile comprising the yarn of any of examples to 1 to 12.
14. The textile of example 13, wherein the textile comprises a garment and one or more garment accessories.
15. A method of making a yarn, comprising:
    melt-spin processing an elastic core comprised only of one or more materials made from hydrocarbons or other fully-recyclable materials;
    melt-spin processing a sheath comprised only of one or more of polyethylene, other materials made only of hydrocarbons, or other fully-recyclable materials;
    disposing the sheath around the elastic core to form a fully-recyclable yarn made only of one or more of hydrocarbons or other fully-recyclable materials,
    wherein the sheath and the clastic core can be recycled together without separation and while maintaining tensile properties of the original yarn in the fully-recyclable yarn.
16. The method of example 15, wherein both the elastic core and the sheath comprises thermoplastic.
17. The method of example 15 or 16, wherein the one or more of materials made from hydrocarbons comprises one or more materials made only from hydrocarbons.
18. The method of any of examples 15 to 17, wherein at least one of the elastic core or the sheath comprises at least one of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same.
19. The method of any of examples 15 to 18, wherein neither the polyethylene nor the olefin block copolymer when it is present, is cross-linked.
20. The method of any of examples 15 to 19, wherein the yarn comprises one or more of the following properties:
    (i) high tensile strength approximately in the range of about 0.3 GPa to about 1.5 GPa; or
    (ii) elastic recovery approximately in the range of about 90% stretch deformation to about 100% stretch deformation.
21. The method of any of examples 15 to 20, wherein the yarn exhibits an auxetic behavior with a negative Poisson ratio approximately in a range from about −0.1 to about −20.
22. The method of any of examples 15 to 21, wherein the yarn is fully-recyclable either mechanically or chemically while maintaining a tensile strength of the original yarn in the fully-recyclable yarn.
23. The method of any of examples 15 to 22, wherein the yarn is fully-recyclable both mechanically and chemically while maintaining a tensile strength of the original yarn in the fully-recyclable yarn.
24. A method of manufacturing a textile, comprising:
    manufacturing a garment;
    adding one or more accessories to the garment, the accessories comprising at least one of the yarn of any of examples 1 to 12 or the yarn made via the method of any of examples 15 to 23.

25. The method of example 24, further comprising:

recycling the garment and the one or more accessories; and manufacturing a second garment from the recycled garment and the one or more accessories.

One skilled in the art will appreciate further features and advantages of the disclosures based on the provided for descriptions and embodiments. Accordingly, the inventions are not to be limited by what has been particularly shown and described. All publications and references cited herein are expressly incorporated herein by reference in their entirety.

Some non-limiting claims are provided below.

What is claimed is:

1. A yarn, comprising:

at least one continuous elastic core filament; and at least one continuous sheath filament distinct from the at least one continuous core filament, the at least one continuous sheath filament including a polyethylene homopolymer of copolymer having a first tensile strength value of at least 0.3 GPa:

wherein the at least one continuous elastic core; filament comprises an olefin block copolymer having a block structure with at least one soft segment and at least one hard segment, and exhibits elongation at break of at least 300% and elastic recovery of at least 60% under 300% stretch deformation;

wherein the at least one continuous sheath filament is helically wound around the at least one elastic core filament to form a core sheath yarn, and wherein, after the yarn is melt-reprocessed to obtain a reprocessed material, the melt-reprocessing occurring without separating the at least one continuous elastic core filament and the at least one continuous sheath filament from one another prior to melt-reprocessing, the reprocessed material is capable of being re-extruded into a yarn that retains at least 80% of the first tensile strength value.

2. The yarn of claim 1, wherein at least one of the at least one continuous elastic core filament or the at least one continuous sheath filament comprises at least one of single component fiber, bi-component fiber, or tri-component fiber.

3. The yarn of claim 2, wherein the at least one of single component fiber, bi-component fiber, or tri-component fiber comprises at least one of a core-sheath fiber type, a side-by-side fiber type, or an islands-in-the sea fiber type.

4. The yarn of claim 1, wherein the at least one continuous sheath filament comprises at least one of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same.

5. The yarn of claim 1, wherein the yarn exhibits elastic recovery approximately in the range of about 90% to about 100% after being axially stretched to reach 100% strain deformation.

6. A yarn, comprising:

at least one elastic core filament; and at least one continuous sheath filament distinct from the at least one continuous elastic core filament, the at least one continuous sheath filament comprising a polyethylene homopolymer or copolymer having a tensile strength of at least 0.3 GPa;

wherein the at least one continuous elastic core, filament comprises an olefin block copolymer having a block structure with at least one soft segment and at least one hard segment, wherein the yarn exhibits a Poisson ratio approximately in a range from about −0.1 to about −20 when uniaxially stretched, wherein the at least one continuous sheath filament is helically wound around the at least one continuous elastic core filament to form a core sheath yarn, and wherein a ratio of the Young's modulus of the at least one continuous elastic core filament to the Young's modulus of the at least one continuous sheath filament is between 8 and 35, and wherein, after the yarn is melt-reprocessed to obtain a reprocessed material, the melt-reprocessing occurring without separating the at least one continuous elastic core filament and the at least one continuous sheath filament from one another prior to melt-reprocessing, the reprocessed material is capable of being re-extruded into a yarn that retains at least 80% of the first tensile strength value.

7. The yarn of claim 6, wherein neither the polyethylene nor an olefin block copolymer, when it is present in at least one of the at least one continuous elastic core filament or the at least one continuous sheath filament, is cross-linked.

8. The yarn of claim 1, wherein the yarn is fully-recyclable either mechanically or chemically while maintaining a tensile strength of the yarn such that a recycled yarn formed from the yarn has at least the same tensile strength as the yarn.

9. The yarn of claim 1, wherein the yarn is fully-recyclable both mechanically and chemically while maintaining a tensile strength of the yarn such that a recycled yarn formed from the yarn has at least the same tensile strength as the yarn.

10. A method of making a recyclable elastic yarn, comprising:

melt-spin processing at least one continuous elastic core filament from an olefin block copolymer having a block structure with at least one soft segment and at least one bard segment;

melt-spin processing at least one continuous sheath filament from a polyethylene homopolymer or copolymer having a tensile strength of at least 0.3 GPa; and feeding the at least one continuous elastic core filament, under tension, to reach at least 100% elongation, and releasing the tension after the elastic van is formed, and feeding the at least one continuous sheath filament, without tension, and helically winding it around the core filament to form a core-sheath yarn in which the at least one continuous sheath filament is helically wound around the at least one continuous elastic core filament;

wherein the at least one continuous elastic core filament and the at least one sheath filament are non-cross-linked all-hydrocarbon polyolefin polymers.

11. The method of claim 10, wherein the at least one continuous sheath filament comprises at least one of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same.

12. The method of claim 10, wherein the yarn is fully-recyclable either mechanically or chemically while maintaining a tensile strength of the original yarn in the fully-recyclable yarn.

13. A method of manufacturing a textile, comprising:

manufacturing a textile that comprises the yarn of claim 1;

adding any other yarns of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same; and adding one or more accessories to the textile, the one or more accessories comprising one or more of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same.

14. A method of manufacturing a textile, comprising:

manufacturing a textile that comprises the yarn of claim 6;

adding any other yarns of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same; and adding one or more accessories to the textile, the one or more accessories comprising one or more of a low density polyethylene (LDPE), a linear low density polyethylene (LLDPE), a medium density polyethylene (MDPE), a high density polyethylene (HDPE), an ultra-high molecular weight polyethylene (UHMWPE), an olefin block co-polymer (OBC), or a blend of any of the same.

15. The method of claim 10, wherein the yarn exhibits an auxetic behavior with a negative Poisson ratio approximately in a range from about −0.1 to about−20.

16. The yarn of claim 1, wherein the yarn is a fancy yarn.

17. The yarn of claim 1, wherein neither the polyethylene nor an olefin block copolymer, when it is present in at least one of the at least one continuous elastic core filament or the at least one continuous sheath filament, is cross-linked.

18. The yarn of claim 1, wherein each of the at least one continuous sheath filaments has a diameter between about 25 microns and about 75 microns.

19. The yarn of claim 6, wherein each of the at least one continuous sheath filaments has a diameter between about 25 microns and about 75 microns.

* * * * *